US007753708B2

(12) United States Patent
Yoshida et al.

(10) Patent No.: US 7,753,708 B2
(45) Date of Patent: Jul. 13, 2010

(54) CONNECTOR UNIT

(75) Inventors: Haruki Yoshida, Shizuoka (JP); Eiji Fukuda, Shizuoka (JP); Sumito Atsumi, Shizuoka (JP); Hiroshi Kobayashi, Aichi (JP); Kiyoka Matsubayashi, Aichi (JP); Fumitoshi Akaike, Aichi (JP); Masatoshi Mori, Aichi (JP)

(73) Assignees: Yazaki Corporation, Tokyo (JP); Toyota Bashoku Kabushiki Kaisha, Kariya-shi (JP)

( * ) Notice: Subject to any disclaimer, the term of this patent is extended or adjusted under 35 U.S.C. 154(b) by 0 days.

(21) Appl. No.: 11/893,950

(22) Filed: Aug. 17, 2007

(65) Prior Publication Data

US 2008/0057768 A1 Mar. 6, 2008

(30) Foreign Application Priority Data

Aug. 23, 2006 (JP) ..... 2006-226584

(51) Int. Cl.
*H01R 13/625* (2006.01)

(52) U.S. Cl. ..... 439/345

(58) Field of Classification Search ..... 439/345, 439/374, 469, 358, 492, 405; 297/410
See application file for complete search history.

(56) References Cited

U.S. PATENT DOCUMENTS

| | | | | |
|---|---|---|---|---|
| 5,762,513 | A * | 6/1998 | Stine | 439/358 |
| 6,350,143 | B2 * | 2/2002 | Kato et al. | 439/374 |
| 2008/0054701 | A1 * | 3/2008 | Yoshida et al. | 297/410 |
| 2008/0057774 | A1 * | 3/2008 | Yoshida et al. | 439/374 |

FOREIGN PATENT DOCUMENTS

| | | | |
|---|---|---|---|
| JP | 200040556 | A * | 2/2000 |
| JP | 2003-299549 | | 10/2003 |

* cited by examiner

*Primary Examiner*—Edwin A. Leon
(74) *Attorney, Agent, or Firm*—Kratz, Quintos & Hanson, LLP

(57) ABSTRACT

A headrest side connector unit mounted on a headrest of a vehicle includes a stay as a holder and a connector. The connector includes a projection 430 to be received in a projection insertion hole formed on the stay. A tip part of the second connector at a side to be connected to the mating connector is disposed further outside of the stay than an end of the stay near a seat. An outer surface of the tip part is arranged on the same plane as an outer surface of the end of the stay.

9 Claims, 21 Drawing Sheets

CONNECTOR UNIT

CROSS REFERENCE TO RELATED APPLICATIONS

This application is on the basis of Japanese Patent Application No. 2006-226584, the contents of which are hereby incorporated by reference.

BACKGROUND OF THE INVENTION

1. Field of the Invention

The present invention relates to a connector unit having a connector used for connecting an electric wire or the like.

2. Description of the Related Art

Various electronic components such as a monitor or a whiplash injury prevention system may be mounted on a headrest of a vehicle. Conventionally, various connector units (for example, see FIG. 21 and Patent Document 1) are used for supplying electric power and signals to the electronic components mounted on the headrest.

A connection unit 101 as shown in FIG. 21 includes: a cylindrical holder 110 mounted on a seat 100; a connector 120 received in the holder 110; a second cylindrical holder 210 mounted on the headrest 200; and a second connector 220 received in the second holder 210. Further, a reference numeral 205 in FIG. 21 indicates a monitor as the electronic component. The connection unit 101 is assembled by inserting the second holder 210 into the holder 110, and connecting the second connector 220 to the connector 120. This assembled connection unit 101 connects the electronic components in a vehicle body to the monitor 205 in the headrest 200 to supply the electric power and the signals to the monitor 205.

Patent Document 1: Japanese Published Patent Application No. 2003-299549

The second holder 210 of the connection unit 101 is made of metal. Therefore, there is a problem that when the second holder 210 is inserted into the holder 110, an edge 220*a* at a top end of the second holder 210 may strike an inner surface of the holder 110 to injure the inner surface of the holder 110 or the connector 120.

Further, in the connection unit 101, because the connectors 120, 220 are connected to each other by inserting the second holder 210 into the holder 110, it is necessary that the connectors 120, 220 are surely fixed to the holders 110, 210 for preventing the connectors 120, 220 from falling out of the holders 110, 210 or being dislocated.

Further, in the connection unit 101, because the connectors 120, 220 are connected to each other by inserting the second holder 210 into the holder 110, it is necessary that an inner diameter of the holder 110 is slightly larger than an outer diameter of the second holder 210. However, if a difference between the inner and outer diameters is too large, there is a problem that a dust may enter a space between the holder 110 and the second holder 210, or the headrest 200 mounted on the seat 100 gets rickety.

Accordingly, a first object of the present invention is to provide a connector unit to prevent an edge at a tip of a holder from injuring other components, and to surely fix a connector to the holder. A second object of the present invention is to provide the connector unit to prevent the edge at the tip of the holder from injuring other components, and to minimize a gap between the holder and a member on which the holder.

SUMMARY OF THE INVENTION

In order to attain the object, according to the present invention, there is provided a connector unit including:

a tubular metallic holder; and a connector received in the holder, wherein a projection is mounted on one of the holder or the connector and projected toward the other one of the holder or the connector, and a projection receiving hole for fastening the holder and the connector by receiving the projection is mounted on the other one of the holder or the connector, and wherein a tip end of the connector at a side to be connected to a mating connector is disposed further outside of the holder than an end of the holder in a longitudinal direction thereof.

Preferably, an outer surface disposed at the tip end of the connector at the side to be connected to the mating connector around an axis of the holder is arranged on the same plane as an outer surface of the end of the holder.

Preferably, the connector is connected to the mating connector when the holder is inserted into a tubular mating holder receiving the mating connector to be connected to the connector.

According to another aspect of the present invention, there is provided a connector unit including:

a tubular metallic holder; and a connector received in the holder, wherein the connector unit further includes engaging members mounted on the holder and on the connector to be engaged with each other, wherein a tip end of the connector at a side to be connected to a mating connector is disposed further outside of the holder than an end of the holder in a longitudinal direction thereof, and wherein an outer surface disposed at the tip end of the connector at the side to be connected to a mating connector around an axis of the holder is arranged on the same plane as an outer surface of the end of the holder.

These and other objects, features, and advantages of the present invention will become more apparent upon reading of the following detailed description along with the accompanied drawings.

BRIEF DESCRIPTION OF THE DRAWINGS

FIG. 5 is a front view showing a receiving member of the seat side connector unit of the connection unit shown in FIG. 1, a first connector, and the like;

DETAILED DESCRIPTION OF THE PREFERRED EMBODIMENTS

A connector unit according to an embodiment of the present invention will be explained with reference to FIGS. 1 to 20. A headrest side connector unit 41 shown in FIG. 1 composes a connection unit 1 used for supplying electric power and signals to various electronic components such as a monitor or a whiplash injury prevention system mounted on a headrest of a vehicle.

Figure 1:
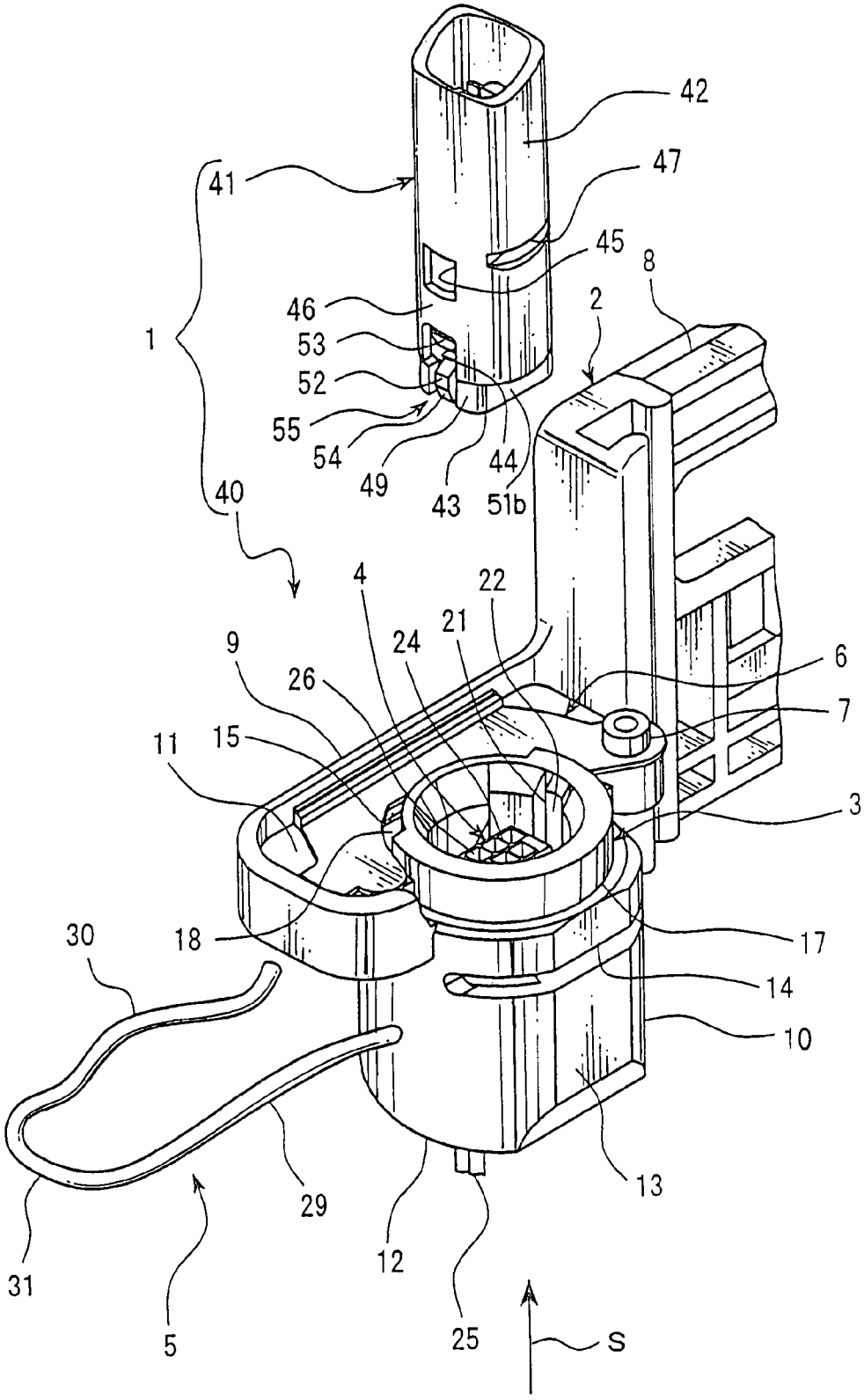
FIG. 1 is a perspective view showing a connection unit according to an embodiment of the present invention.

As shown in FIG. 1, the connection unit 1 includes: a seat side connector unit 40; the headrest side connector unit 41; and a clip 5.

Figure 2:
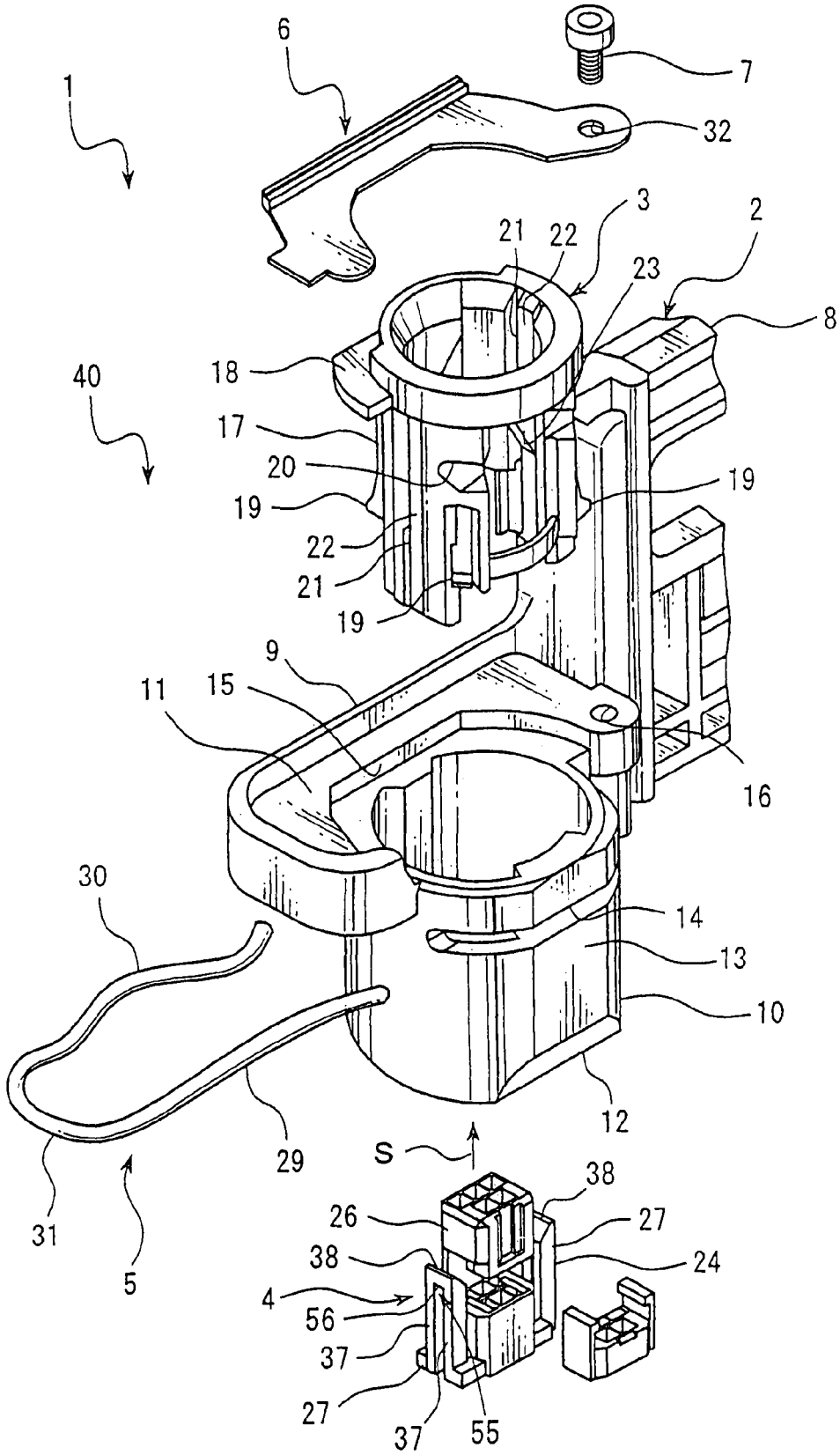
FIG. 2 is an exploded perspective view showing a seat side connector unit of the connection unit shown in FIG. 1.

As shown in FIGS. 1 and 2, the seat side connector unit 40 includes: a bracket 2; a holder 3 as a mating holder; a first connector 4 as a mating connector; a plate 6 (shown in FIG. 2); and a bolt 7 (shown in FIG. 2).

Figure 5:
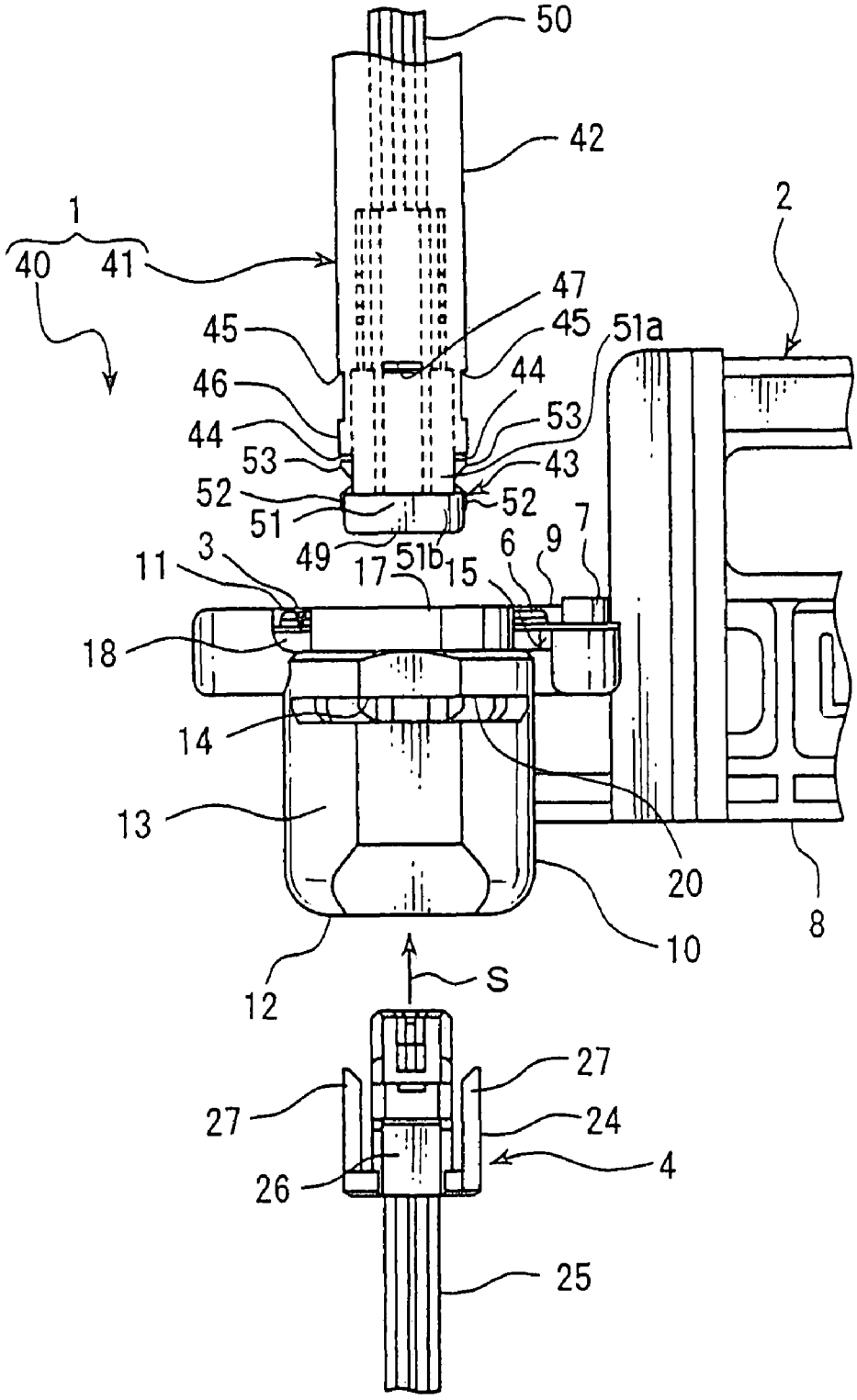
Figure 6:
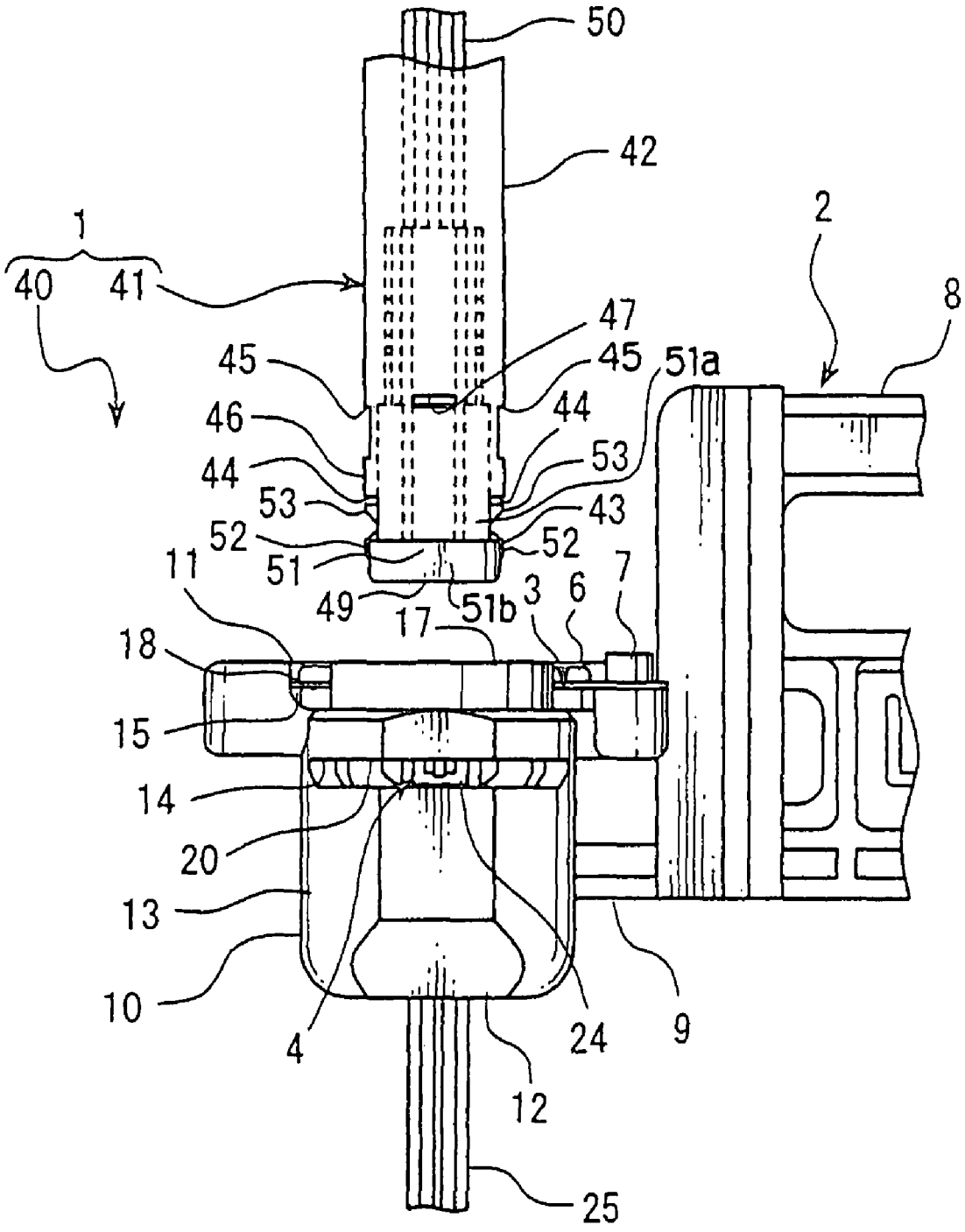
FIG. 6 is a front view showing the first connector shown in FIG. 5 held in the receiving member.

The bracket 2 is made of insulating synthetic resin, and mounted on a seat of a vehicle. The bracket 2 includes: a plate-shaped main body 8; and a pair of receiving members 9. The main body 8 connects the pair of receiving members 9. The pair of receiving members is arranged in parallel to each other with a gap. The receiving member 9 includes: a receiving member main body 10; and a flange 11. As shown in FIGS. 5 and 6, the receiving member main body 10 integrally includes a disk shaped bottom wall 12 and a cylinder 13 vertically extended from an outer edge of the bottom wall 12.

A slit 14 penetrates the cylinder 13. The slit 14 is extended straight perpendicular to an axis of the receiving member main body 10. The slit 14 communicates with a later-described straight notch 20 formed on the holder 3 and a later-described straight slit 47 formed on a stay 42. The receiving member main body 10 receives the holder 3 to hold the holder 3.

The flange 11 is formed in a plate shape, and extended from an outer edge of the cylinder 13 of the receiving member main body 10 away from the bottom wall 12 in a radius direction of the cylinder 13 of the receiving member main body 10. The flange 11 is formed on about a half round of the outer edge of the cylinder 13 away from the bottom wall 12. A step 15 for gradually thickening the flange 11 toward an outer circumference of the flange 11 is formed on the flange 11. Further, at an end of the flange 11 near the main body 8, a bolt insertion hole 16 is formed, and a nut of which tapped hole communicates with the bolt insertion hole 16 is embedded.

The holder 3 is made of insulating synthetic resin, and formed in a cylindrical shape as a whole. As shown in FIG. 2, the holder 3 integrally includes a cylindrical holder main body 17 and a flange 18. A plurality of notches and holes are formed on the holder main body 17, and the holder main body 17 is formed in a cylindrical shape as a whole. The holder main body 17 is received in the receiving member main body 10. Therefore, the holder 3 is attached to the seat via the receiving member main body 10, namely, the bracket 2.

As shown in FIG. 2, a plurality of resiliently deformable arms 19, the straight notch 20, and holder locking arms 21 are formed on the holder main body 17. The resiliently deformable arm 19 is formed in a resiliently deformable bar shape, and one end of the resiliently deformable arm 19 is extended to the holder main body 17. The resiliently deformable arm 19 is resiliently deformable in a direction that the other end thereof is attached to and detached from the holder main body 17. When the holder main body 17 is received in the receiving member main body 10, the other end of the resiliently deformable arm 19 contacts an inner wall of the cylinder 13 of the receiving member main body 10. By the other end of the resiliently deformable arms 19 contacting the inner wall of the cylinder 13 of the receiving member main body 10, the resiliently deformable arm 19 movably supports the holder main body 17 in the receiving member main body 10, and constantly urges the holder main body 17 toward the center of the receiving member main body 10.

The straight notch 20 is a through hole of the holder main body 17, and extended in a direction perpendicular to the axis of the holder main body 17 of the holder 3. When the holder main body 17 of the holder 3 is received in the receiving member main body 10 of the receiving member 9, the straight notch 20 is overlapped with the slit 14 and communicates with the slit 14.

In FIG. 2, a pair of holder locking arms 21 is provided. The holder locking arms 21 are disposed facing each other while the center of the holder main body 17 is disposed between the holder locking arms 21. As shown in FIG. 2, each holder locking arm 21 includes a bar-shaped arm main body 22 and a locking projection 23. A long side of the arm main body 22 is arranged along the axis of the holder main body 17. Both ends of the arm main body 22 is integrally formed with the holder main body 17, and the other parts of the arm main body 22 is separated with the holder main body 17. Namely, the arm main body 22 is supported at both ends thereof. A locking projection 23 is disposed in the center of the long side of the arm main body 22. The arm main body 22 is projected toward the other arm main body 22.

The flange 18 is formed in a plate shape, and extended in a radial direction from one end near the flange 11 when the holder main body 17 is received in the receiving member main body 10. The flange 18 is formed on about a half round of the one end of the holder main body 17.

The flange 18 of the holder 3 is overlapped with the flange 11 of the receiving member 9 when the holder main body 17 is received in the receiving member main body 10 of the receiving member 9. At this time, the flange 18 of the holder 3 is disposed inside of the step 15 of the receiving member 9. The holder 3 holds the first connector 4 when the connector 4 is received in the holder main body 17, and a later-described locking arm 27 of the first connector 4 is engaged with the holder locking arm 21.

Figure 3:
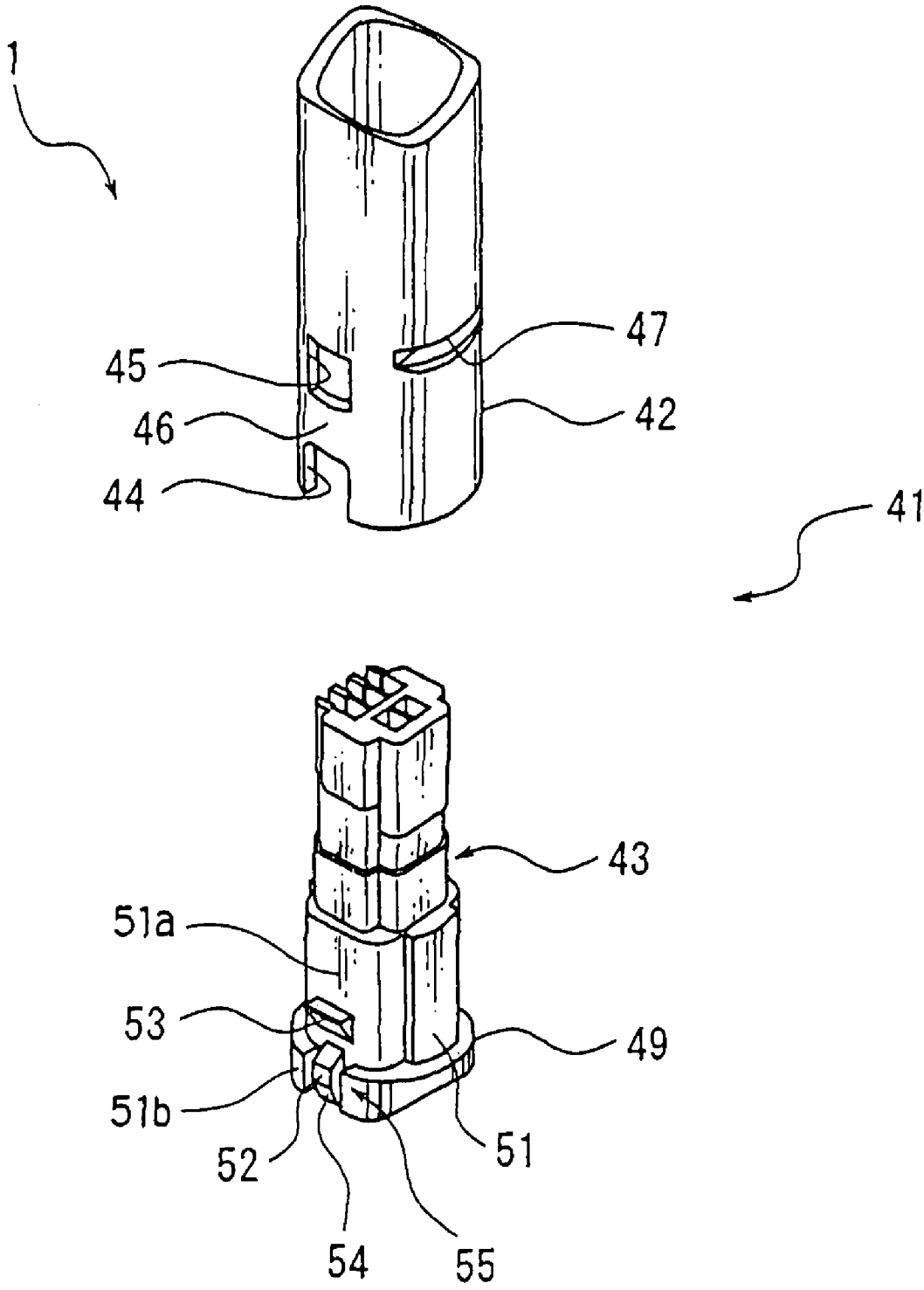
FIG. 3 is an exploded perspective view showing a headrest side connector unit of the connection unit shown in FIG. 1.

As shown in FIGS. 2 and 3, the first connector 4 includes terminal fittings 36 (shown in FIG. 7) and a connector housing 24. The terminal fittings 36 are made of conductive plate metal. Ends of electric wires 25 are attached to the terminal fittings 36 so that the terminal fittings 36 are electrically connected to core wires of the electric wires 25.

The connector housing 24 is made of insulating synthetic resin, and includes a box-shaped housing main body 26 and a locking arm 27 as a first engaging member. A plurality of terminal receiving chambers is formed in the housing main body 26. Each terminal receiving chamber is extended straight. The terminal receiving chambers are arranged in parallel to each other. The terminal receiving chamber is a hole (room) of which both ends are open on outer surfaces of the housing main body 26.

Two locking arms 27 are formed on the connector housing 24. The housing main body 26 is interposed between the locking arms 27. Each locking arm 27 includes a pair of arm members 37 and a locking beak 38 connecting the arm members 37.

Each arm member 37 is formed in a bar shape extending straight, and arranged in parallel to each other with a gap. An end of the arm member 37 is extended to one end of the housing main body 26 away from the headrest side connector unit 41. The arm member 37 is extended from the one end thereof toward the headrest side connector unit 41. The arm members 37 are arranged parallel to the terminal receiving chambers. The locking beak 38 connects the other ends of the pair of arm member 37 to each other.

The locking projection 23 is interposed between the pair of arm member 37 and the locking beak 38, and the holder locking arms 21 are engaged with the other ends of the locking arms 27. Thus, the one ends of the locking arms 27 away from a later-described second connector 43 to be connected to the first connector 4 is extended to the housing main body 26. The locking arms 27 are allowed to be engaged with the holder locking arms 21. By engaging with the holder locking arms 21, the locking arms 27 hold the first connector 4 in the holder 3.

The first connector 4 is inserted into the holder main body 17 of the holder 3 from an end of the holder main body 17 away from the flange 11 to be received in the holder main body 17. When the locking projections 23 are engaged with the other end of the locking arms 27, the first connector 4 is held in the holder main body 17 of the holder 3. Incidentally, the first connector 4 is inserted into the holder main body 17 along an arrow S parallel to the axis of the holder main body 17 and the longitudinal direction of the terminal receiving chambers.

The plate 6 is made of thick metal plate and formed in a plate shape. A locking part for locking the flange 11 is formed on an end of the plate 6, and a bolt insertion hole 32 for the bolt 7 is formed on the other end of the plate 6. While the locking part is locked with the flange 11, the plate 6 is overlapped with the flange 11. Then, the bolt insertion hole 32 of the plate 6 communicates with the bolt insertion hole 16 formed on the flange 11 of the receiving member 9.

The plate 6 catches the flange 18 of the holder 3 with the flange 11 of the receiving member 9. Then, when the bolt 7 is screwed with the nut via the bolt insertion holes 32, 16, the plate 6 is attached to the flange 11 of the receiving member 9. The plate 6 fixes the holder 3 to the receiving member 9 by catching the flange 18 of the holder 3 with the flange 11 of the receiving member 9.

The seat side connector unit 40 having a structure described above is assembled as described below. First, as shown in FIG. 5, the holder main body 17 is inserted into the receiving member main body 10, and the main body 8 is overlapped with the flange 11 to hold the holder 3 in the receiving member 9. Then, the plate 6 is overlapped with the flange 18 of the holder 3, and fixed to the flange 11 of the receiving member 9 with the bolt 7.

Next, the connector 4 is opposed to an opening formed on the bottom wall 12. Then, the first connector 4 is inserted into the holder main body 17 of the holder 3, and held in the holder main body 17 as shown in FIG. 6. Thus, the seat side connector unit 40 is assembled.

As shown in FIGS. 3 and 4, the headrest side connector unit 41 includes a stay 42 as a holder, and the second connector 43. The stay 42 is attached to the headrest. The stay 42 is made of metal, and formed in a cylinder shape as a whole. As shown in FIGS. 3 and 4, a pair of notches 44, a pair of insertion holes 45, a pressed part 46, a slit 47, and a projection insertion hole 420 are formed on one end of the stay 42 at the seat side in the longitudinal direction. Further, both inner and outer walls of edges 42*a* of the one end of the stay 42 are extended at an acute angle.

The pair of notches 44 is opposed to each other, and the axis of the stay 42 is interposed between the notches 44. The insertion holes 45 and the notches 44 are arranged along the axis of the stay 42, and a gap is formed between the insertion hole 45 and the notch 44. The insertion holes 45 is a through hole formed on the stay 42. A locking projection 23 of the holder locking arms 21 is inserted into the insertion hole 45 when the connectors 4, 43 are fully connected to each other. Thus, the insertion hole 45 allows the locking projection 23 of the holder locking arm 21 to be inserted into the insertion hole 45 after the connectors 4, 43 are connected to each other, moved relative to the holder 3, and the locking projection 23 is released from an engagement with the first connector 4.

The pressed part is interposed between the notch 44 and the insertion hole 45 arranged along the axis of the stay 42. The pressed part 46 is a part of an outer wall of the stay 42. When the connectors 4, 43 are moved relative to the holder 3 after connected to each other, the locking projection 23 of the holder locking arms 21, which is released from the engagement with the first connector 4, abuts on the pressed part 46, and presses the pressed part 46 with a resilient force of the arm main body 22 of the holder locking arms 21.

The slit 47 is extended straight perpendicular to the axis of the stay 42. The slit 47 is a through hole formed on the stay 42. When the connectors 4, 43 are connected to each other, the slit 47 communicates with the slit 14 and the straight notch 20.

The projection insertion hole 420 is opposed to the slit 47, and the axis of the stay 42 is interposed between the projection insertion hole 420 and the slit 47. The projection insertion hole 420 is a through hole formed on the stay 2. A later-described projection 430 is inserted into the projection insertion hole 420. The projection insertion hole 420 and the projection 430 are engaging members described in claims.

Figure 7:
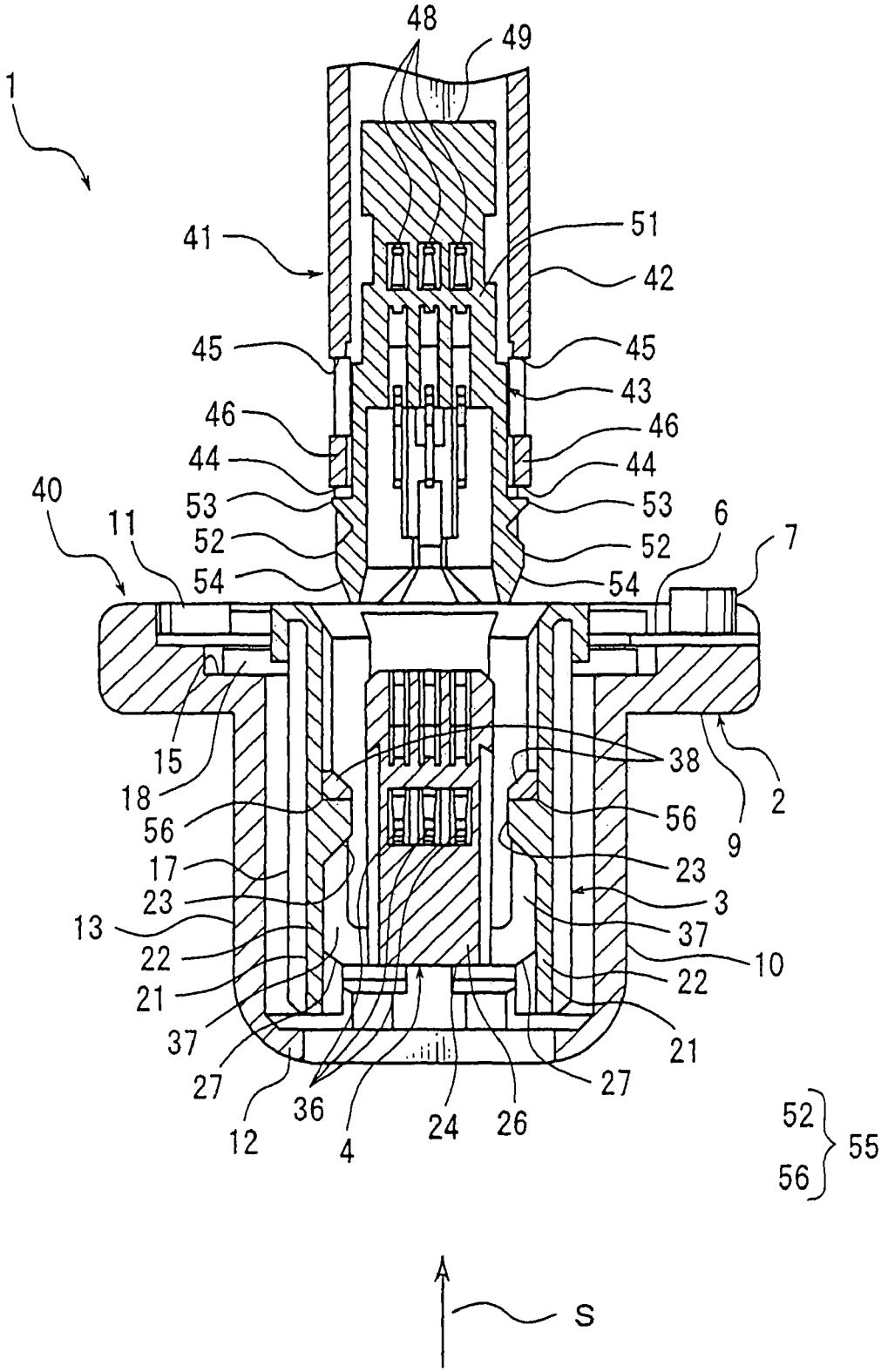
FIG. 7 is a sectional view showing the seat side connector unit and the headrest side connector unit approaching each other.

As shown in FIG. 7, the second connector 43 includes terminal fittings 48 and a connector housing 49. The terminal fittings 48 are made of conductive plate metal. The terminal fittings 48 are attached to ends of electric wires 50 so that the terminal fittings 48 are electrically connected to core wires of the electric wires 50.

A connector housing 49 is made of insulating synthetic resin, and includes a tubular housing main body 51, a locking projection 52, a pressing projection 53, and a projection 430.

A plurality of terminal receiving chambers is formed in the housing main body 51. Each terminal receiving chamber is extended straight. The terminal receiving chambers are arranged in parallel to each other. The terminal receiving chamber is a hole (room) formed in the housing main body 51.

Figure 4A:
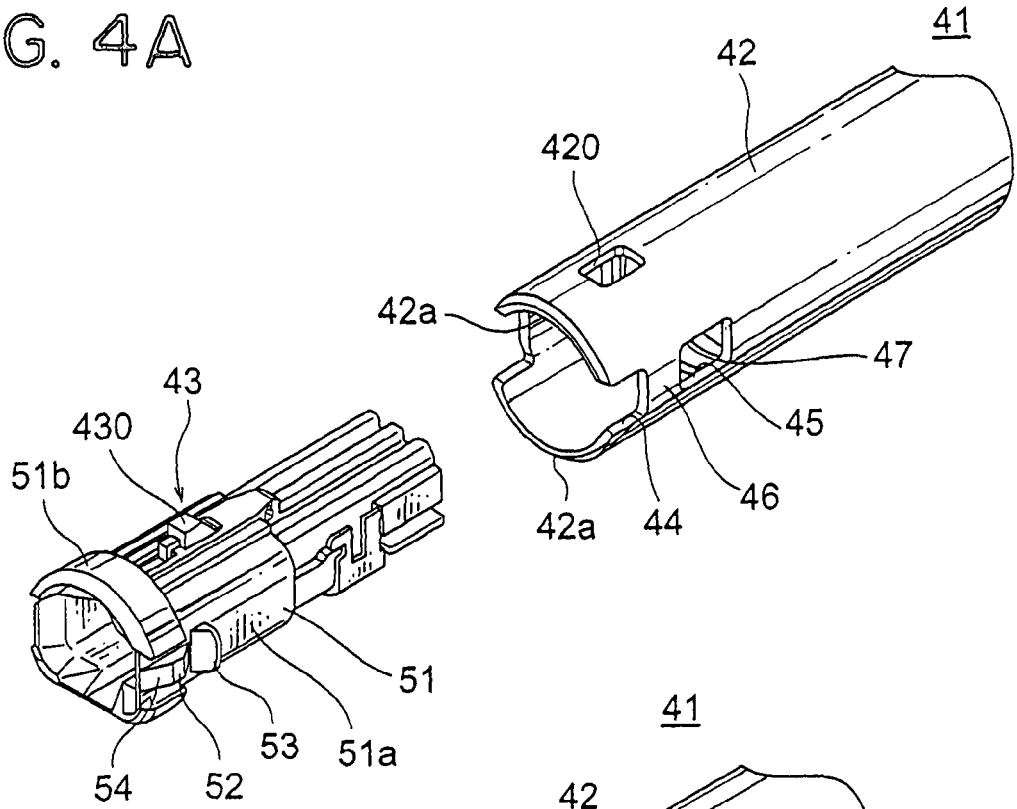
FIG. 4A is an exploded perspective view showing the headrest side connector unit shown in FIG. 3 seeing from another view angle.
Figure 4B:
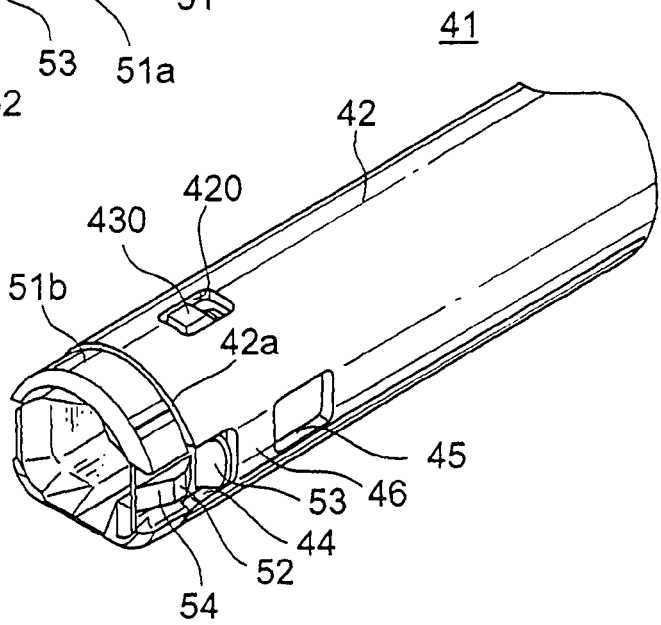
FIG. 4B is a perspective view showing a connector of the headrest side connector unit shown in FIG. 4A and a stay (holder) assembled with each other.

As shown in FIG. 4A, a housing main body 51 has a step which is formed by that most of outer surface of a tip part 51*b* at a side connected to the first connector 4 is disposed further outside of the housing main body 51 in the axis direction of the housing main body 51 than an outer surface of a main part 51*a*. As shown in FIG. 4*b*, the main part 51*a* of the housing main body 51 is received in a tip of the stay 42, namely, one end of the stay 42 at the seat side, and the tip part 51*b* of the housing main body 51 is disposed further outside of the stay 42 than the one end of the stay 42. Namely, while the tip part 51*b* of the housing main body 51 is exposed outside of the stay 42, the housing main body 51 is assembled with the stay 42. Further, while the housing main body 51 is assembled with the stay 42, the outer surface of the tip part 51*b* is arranged in a same plane as the outer surface of the one end of the stay 42. Namely, the outer surface of the headrest side connector unit 41 of which housing main body 51 is assembled with the stay 42 is formed in a substantially flush surface around the axis of the headrest side connector unit 41. Further, when the housing main body 51 is received in the stay 42, the second connector 43 is received in the stay 42, and attached to the headrest via the stay 42.

Two locking projections 52 are formed on the connector housing 49. The housing main body 51 is interposed between the locking projections 52. The locking projections 52 are projected from the tip part 51*b* of the housing main body 51. A tapered wall 54 is formed on each locking projection 52. The tapered wall 54 is so formed that as the tapered wall 54 reaches the seat side connector unit 40, the tapered wall 54 reaches the housing main body 51. Namely, as the tapered wall 54 reaches the seat side connector unit 40, a projecting amount from the housing main body 51 decreases. When the locking projection 52 is interposed between the pair of arm members 37 and the locking beak 38, the locking projection 52 is engaged with the locking arm 27. The locking projections 52 are allowed to be engaged with the locking arms 27. When the locking projections 52 are engaged with the locking arms 27, the connectors 4, 43 are connected to each other.

When the seat side connector unit 40 and the headrest side connector unit 41 are brought to close to each other to insert the second connector 43 into the holder 3, the locking projections 52 are abut on the locking projections 23 of the holder locking arms 21, and deform the arm main body 22 in a direction of separating the locking projections 23 from the housing main body 26 of the first connector 4. The locking projections 23 compose later-described engagement releasing members 55.

Two pressing projections 53 are formed on the connector housing 49. The housing main body 51 is interposed between the pressing projections 53. Each pressing projection 53 is projected from the main part 51*a* near the tip part 51*b* of the housing main body 51. The pressing projections 53 are disposed further away from the seat side connector unit 40 than the locking projections 52. The pressing projections 53 and the locking projections 52 are arranged with gaps along the axis of the stay 42. When the second connector 43 is received in the stay 42, the pressing projections 53 and the locking projections 52 are positioned in the notches 44. When the locking arms 27 and the locking projections 52 are engaged with each other, the pressing projections 53 abut on the locking beaks 38 of the locking arms 27.

The projection 430 is interposed between the pair of pressing projections 53, and projected from the main part 51*a* near the tip part 51*b* of the housing main body 51. As shown in FIG. 4B, when the projection 430 is received in the projection insertion hole 420, the housing main body 51 and the stay 42 are fixed to each other. Further, by bending the housing main body 51, the 430 is released from the projection insertion hole 420, and the housing main body 51 is separated from the stay 42.

After the locking projections 52, namely, later-described engagement releasing members 55 release the engagements between the holder locking arms 21 and the locking arms 27, the locking projections 52 are engaged with the other ends of the locking arms 27, so that the second connector 43 is connected to the first connector 4.

The headrest side connector unit 41 having a structure described above is assembled as described below. First, as shown in FIG. 3, the second connector 43 and the stay 42 are arranged with a gap along the axis of the stay 42. Then, when the second connector 43 is received in the stay 42, and the projection 430 is received in the projection insertion hole 420, the stay 42 and the second connector 43 are fixed to each other. Thus, the headrest side connector unit 41 is assembled.

A clip 5 is made of metal. As shown in FIGS. 1 and 2, the clip 5 integrally includes a straight part 29, a wave part 30 arranged parallel to the straight part 29, and an arc part 31 connecting both one ends of the straight part 29 and the wave part 30. The clip 5 is formed in a substantially U-shape. The clip 5 is resiliently deformable in a direction of approaching and separating the straight part 29 and the wave part 30. When the straight part 29 is inserted into the slit 14, the straight notch 20, and the slit 47, the clip 5 relatively positions the receiving member main body 10, the holder 3, and the stay 42, namely, connectors 4, 43.

Then, the straight part 29 is inserted into the straight notch 20 and the slit 47. The receiving member main body 10 is held between the straight part 29 and the wave part 30. Thus, the clip 5 is attached to the receiving member 9, namely, the seat side connector unit 40 and the headrest side connector unit 41 connected to each other.

The connection unit 1 includes the engagement releasing members 55. Each engagement releasing member 55 includes the locking projection 52, and a tapered wall 56 formed on the locking beak 38 of the locking arm 27 of the first connector 4. The tapered wall 56 is formed at a side away from the headrest side connector unit 41 of the locking beaks 38, and at an edge disposed outside of the connector housing 24 of the first connector 4. The tapered wall 56 approaches the housing main body 26 of the connector housing 24 of the first connector 4 as the tapered wall 56 leaves the headrest side connector unit 41.

When the locking projections 52 and the locking arms 27 are engaged with each other, the engagement releasing members 55 press outward the locking projections 23 to deform the arm main body 22 in a direction of releasing the engagement between the locking projections 23 and the locking arms 27. Then, when the headrest side connector unit 41 is brought closer to the seat side connector unit 40, the locking projections 23 of the holder locking arms 21 run on the tapered walls 56 to fully release the engagements between the holder locking arms 21 and the locking arms 27. Thus, when the locking arms 27 and the locking projections 52 are engaged with each other, and the connectors 4, 43 are connected to each other, the engagement releasing members 55 release the engagements between the holder locking arms 21 and the locking arms 27 to make the connectors 4, 43 movable relative to the holder 3.

The seat side connector unit 40 and the headrest side connector unit 41 having a structure described below are connected to each other as described below. The bracket 2 is attached to the seat, and the stay 42 is attached to the headrest. Then, the seat and the headrest are brought close to each other. First, as shown in FIG. 6, the holder 3 and the second connector 43 are opposed to each other. As shown in FIG. 7, the seat side connector unit 40 and the headrest side connector unit 41 are brought close to each other. At this time, the holder locking arms 21 and the locking arms 27 are engaged with each other, and the first connector 4 is held in the holder 3.

Figure 8:
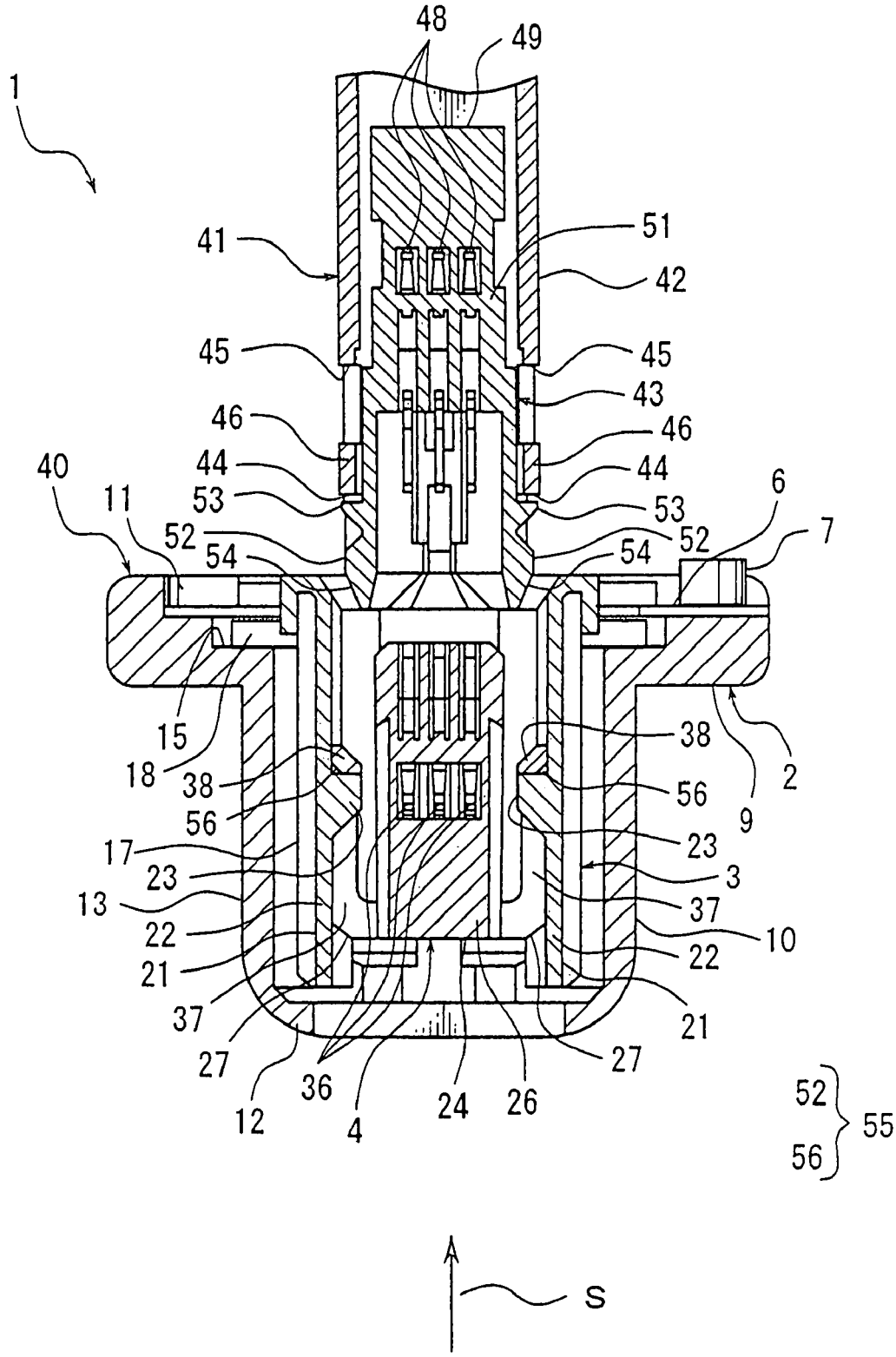
FIG. 8 is a sectional view showing a second connector of the headrest side connector unit inserted into a holder of the seat side connector unit shown in FIG. 7.
Figure 9:
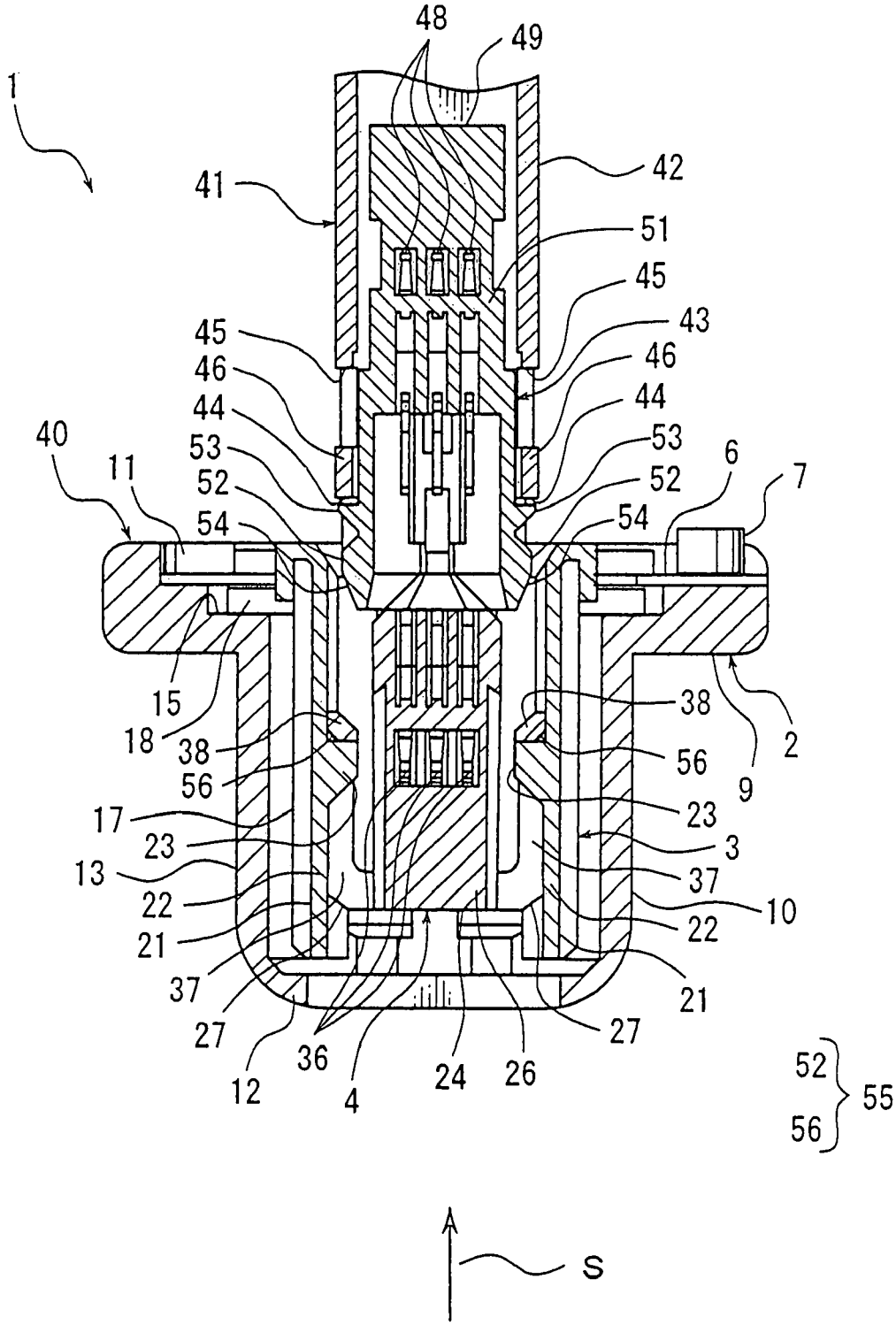
FIG. 9 is a sectional view showing the second connector of the headrest side connector unit further inserted into a center of the holder of the seat side connector unit shown in FIG. 8.
Figure 10:
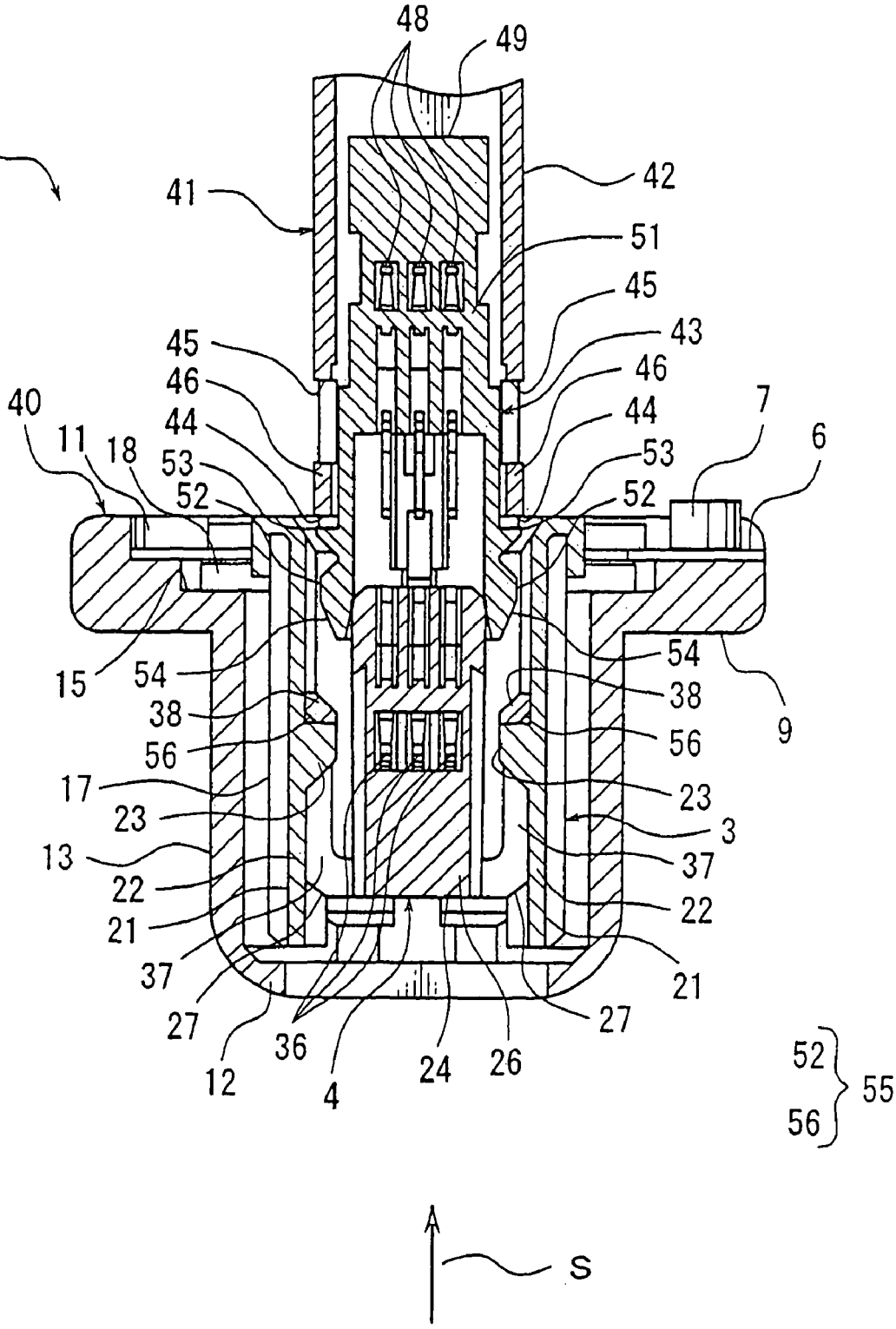
FIG. 10 is a sectional view showing a housing main body of the first connector of the seat side connector unit inserted into the second connector of the headrest side connector unit.
Figure 11:
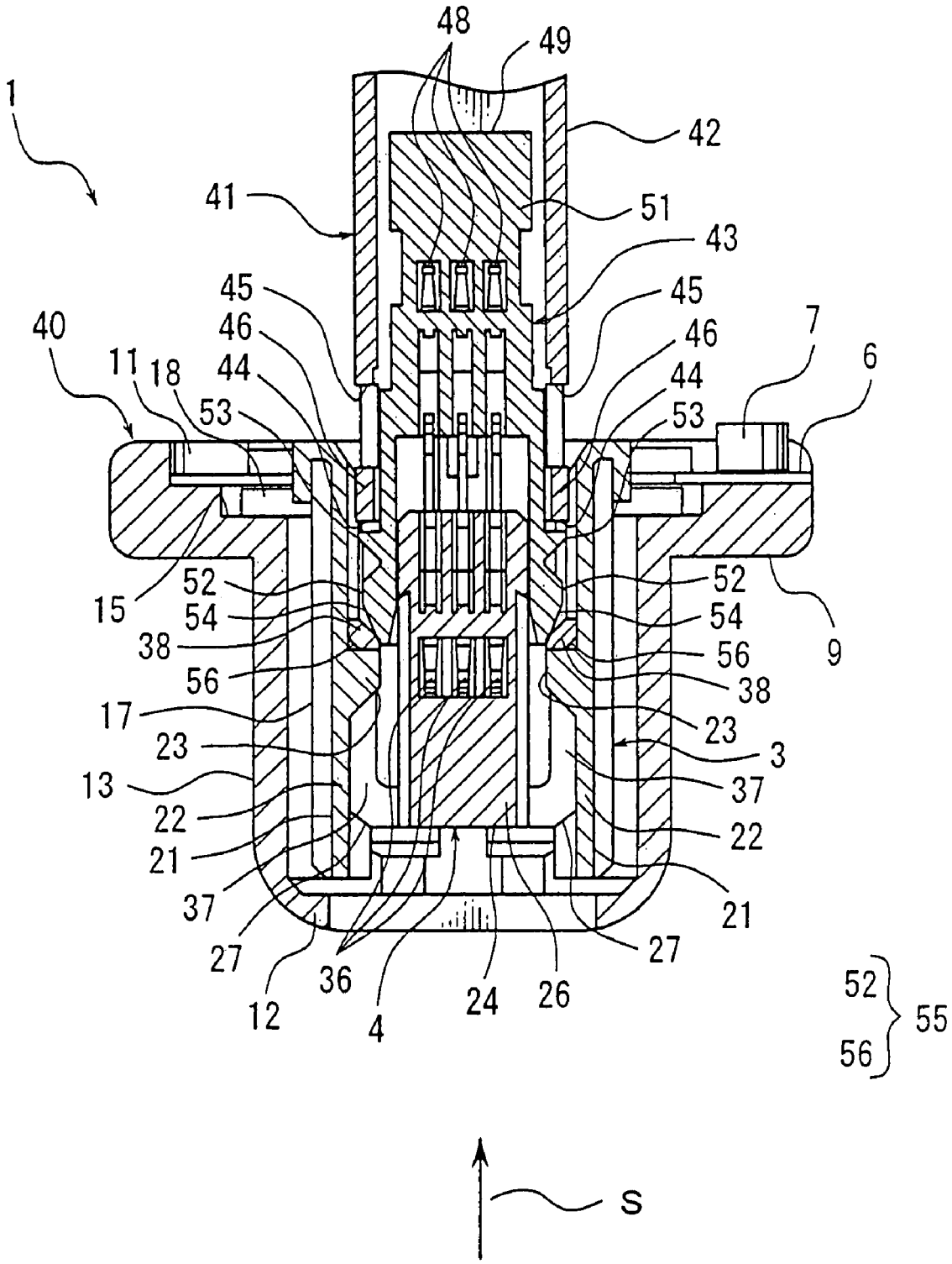
FIG. 11 is a sectional view showing a locking projection of the second connector of the headrest side connector unit abutting on a locking beak of the first connector of the seat side connector unit shown in FIG. 10.

Then, as shown in FIGS. 8 and 9, the second connector 43 is inserted into the holder 3. Then, as shown in FIG. 10, the housing main body 26 of the connector housing 24 of the first connector 4 is inserted into the connector housing 49 of the second connector 43. Then, as shown in FIG. 11, the locking projections 52 of the second connector 43 contact the locking beaks 38 of the locking arms 27 of the first connector 4. Then, the tapered walls 54 of the locking projections 52 press the locking beaks 38, and the locking arms 27 are deformed in directions that the locking beaks 38 are brought away from the housing main body 26.

Figure 12:
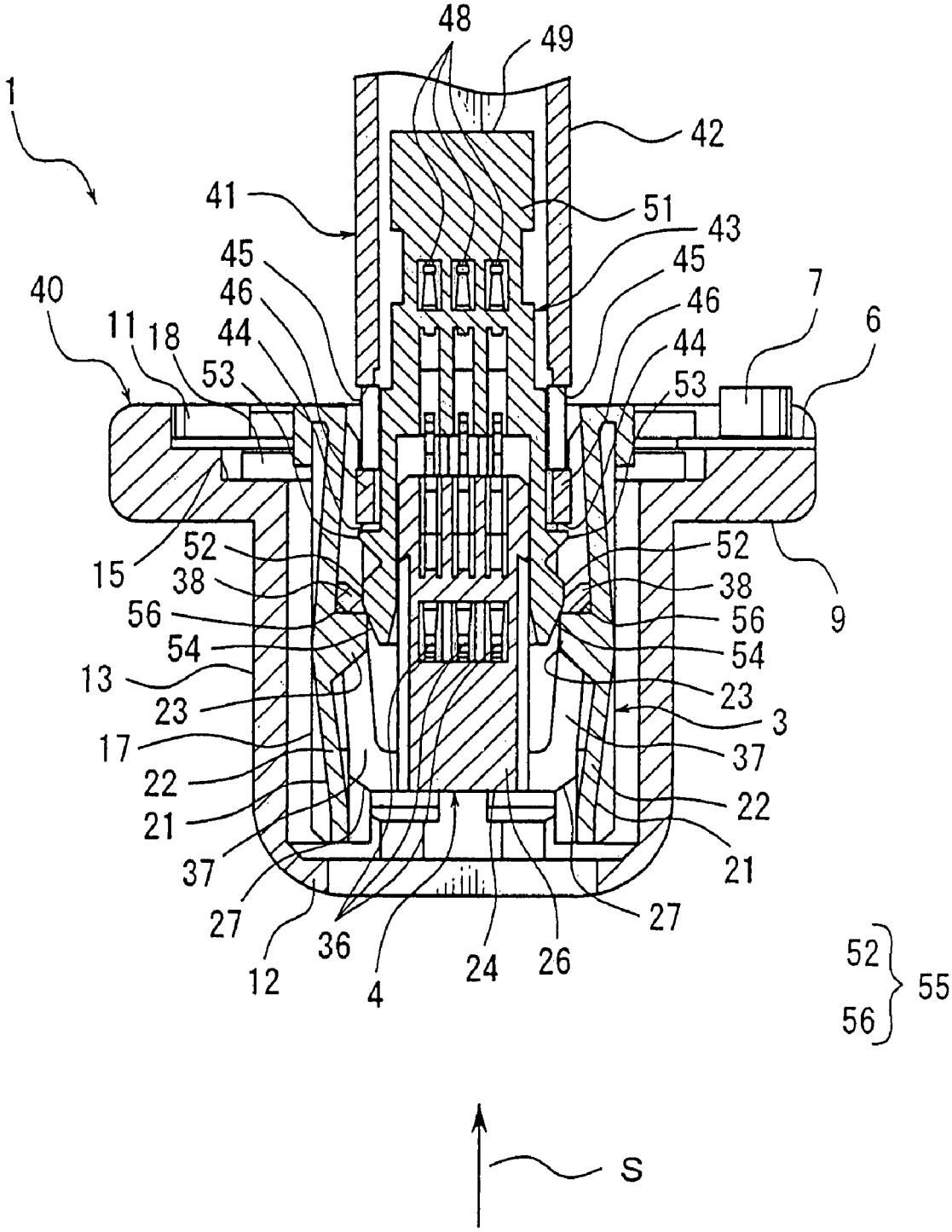
FIG. 12 is a sectional view showing the locking beak of the first connector of the seat side connector unit running on the locking projection of the second connector of the headrest side connector unit.
Figure 13:
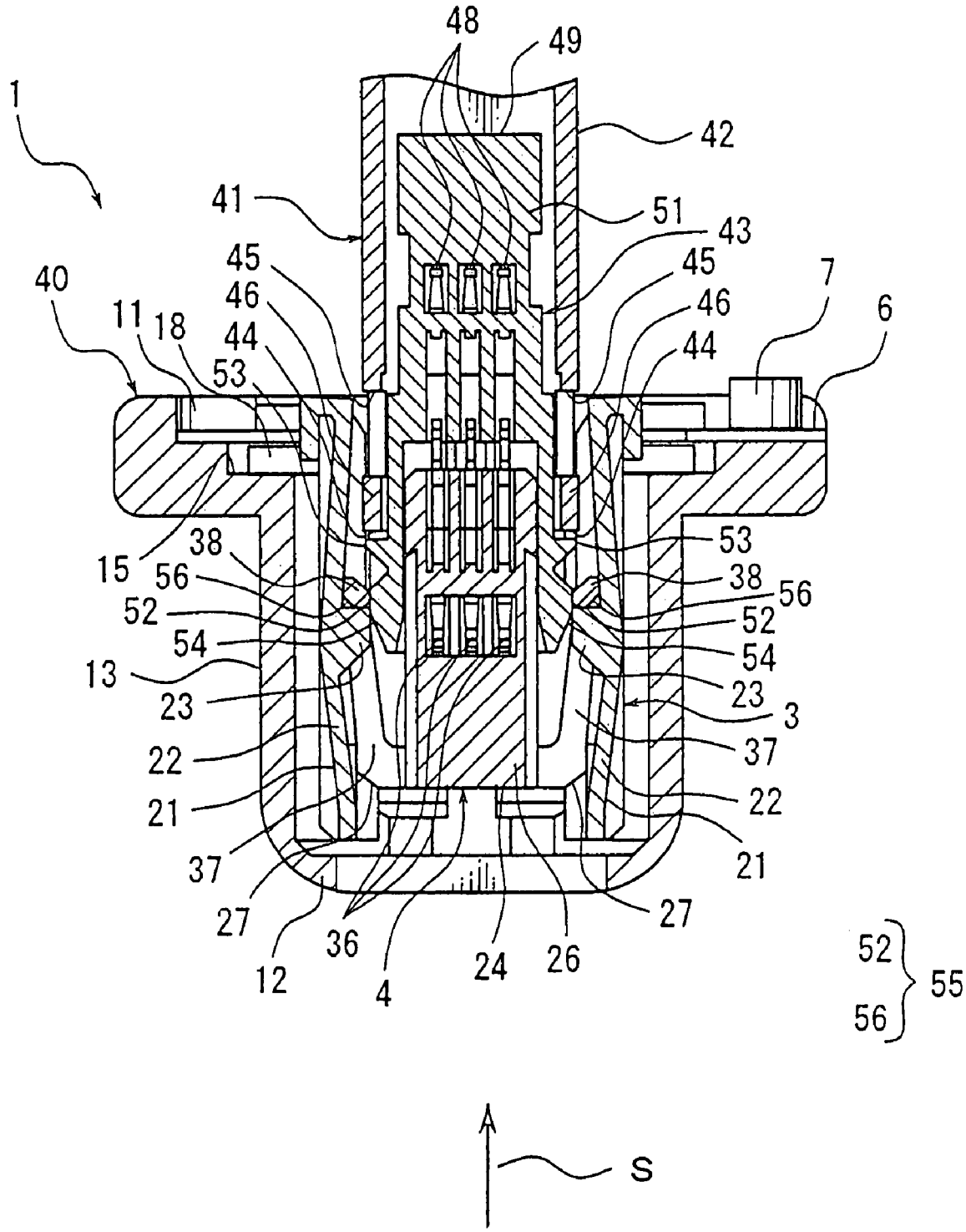
FIG. 13 is a sectional view showing a locking projection of the holder of the seat side connector unit shown in FIG. 12 running on the locking projection of the second connector of the headrest side connector unit.

Further, as shown in FIG. 12, when the second connector 43 of the headrest side connector unit 41 is inserted into the holder 3, the locking projections 23 of the holder locking arms 21 run on the tapered walls 54 of the locking projections 52. Then, as shown in FIGS. 12 to 14, the locking beaks 38 and the locking projection 23 of the holder locking arms 21 run on the locking projections 52 of the second connector 43, so that the holder locking arms 21 are resiliently deformed in directions that the locking projection 23 are brought away from the housing main body 26.

Figure 14:
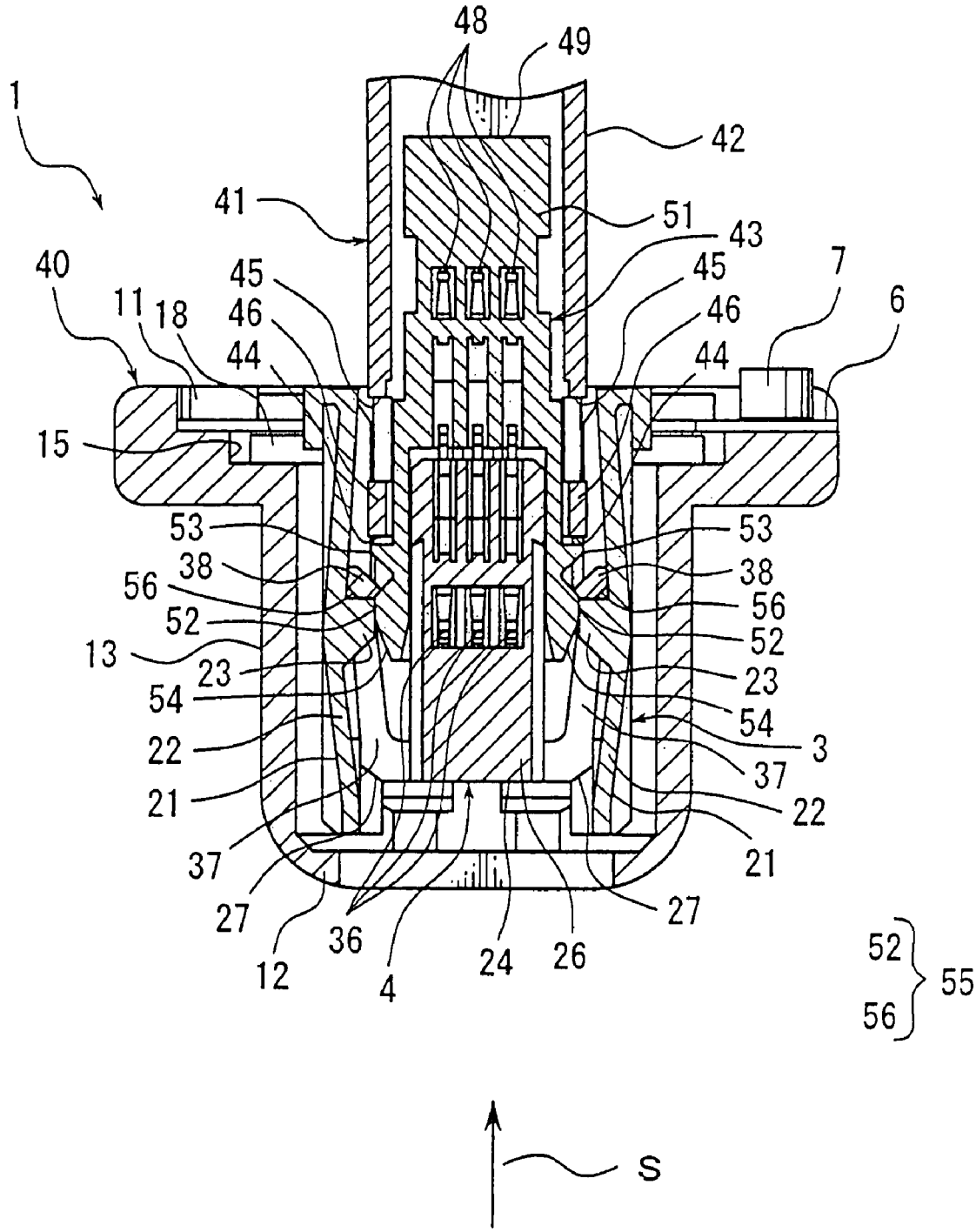
FIG. 14 is a sectional view showing the locking beak of the first connector of the seat side connector unit shown in FIG. 13 running over the locking projection of the second connector of the headrest side connector unit.
Figure 15:
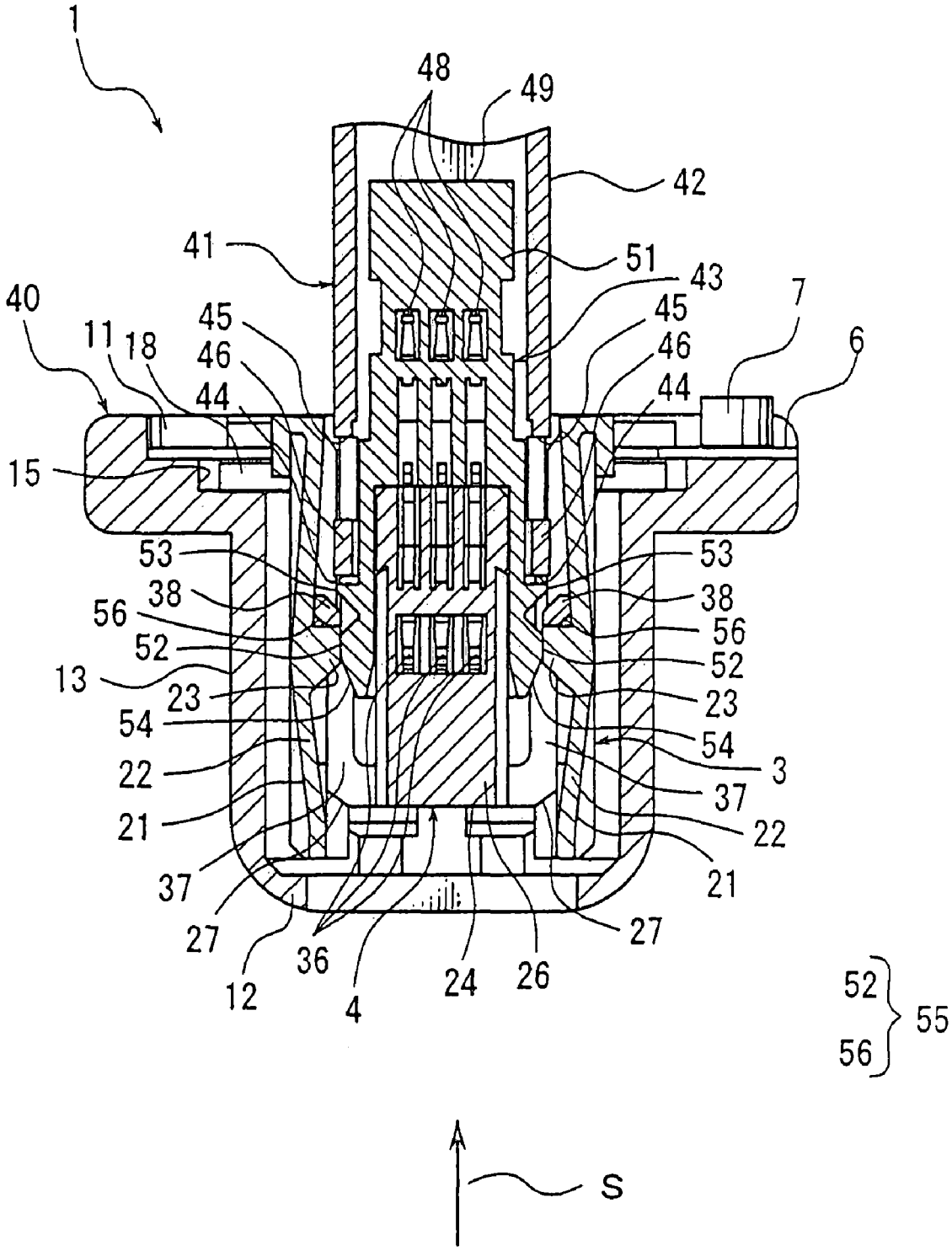
FIG. 15 is a sectional view showing the first connector of the seat side connector unit and the second connector of the headrest side connector unit shown in FIG. 14 connected to each other.

Then, as shown in FIG. 14, when the second connector 43 of the headrest side connector unit 41 is inserted into the holder 3, the locking beaks 38 run over the locking projections 52 of the second connector 43. Then, the locking arms 27 are going to return to neutral positions in directions that the locking beaks 38 are brought close to housing main body 26. Then, as shown in FIG. 15, the locking arms 27 returns to the neutral positions, so that the locking arms 27 and the locking projections 52 are engaged with each other (namely, the connectors 4, 43 are connected to each other). Further, the locking projection 23 of the holder locking arms 21 run on the locking projections 52 of the second connector 43, so that the engagements between the holder locking arms 21 and the locking arms 27 are released.

Figure 16:
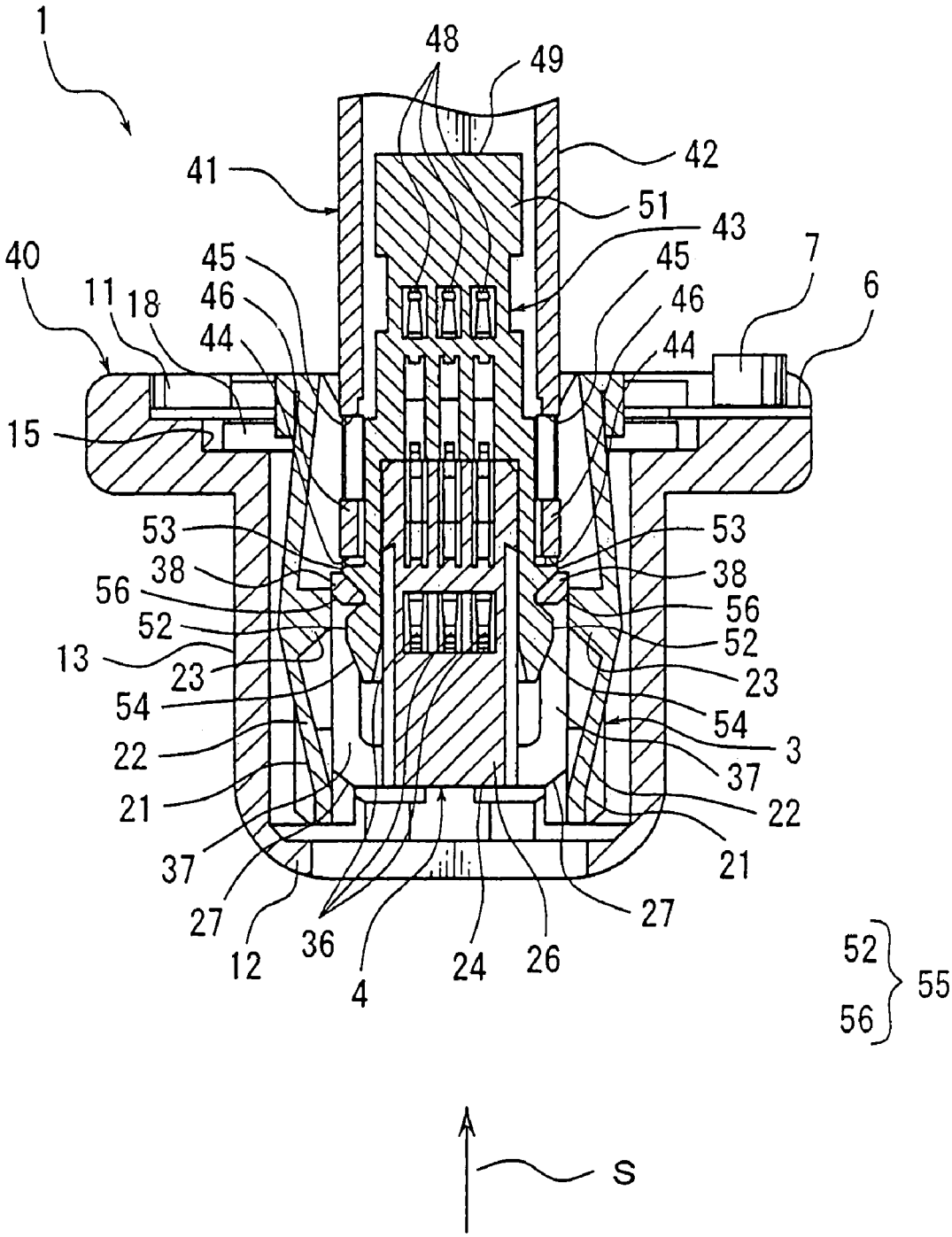
FIG. 16 is a sectional view showing a state that an engagement between a holder locking arm of the holder of the seat side connector unit and the locking arm of the first connector is fully released.
Figure 17:
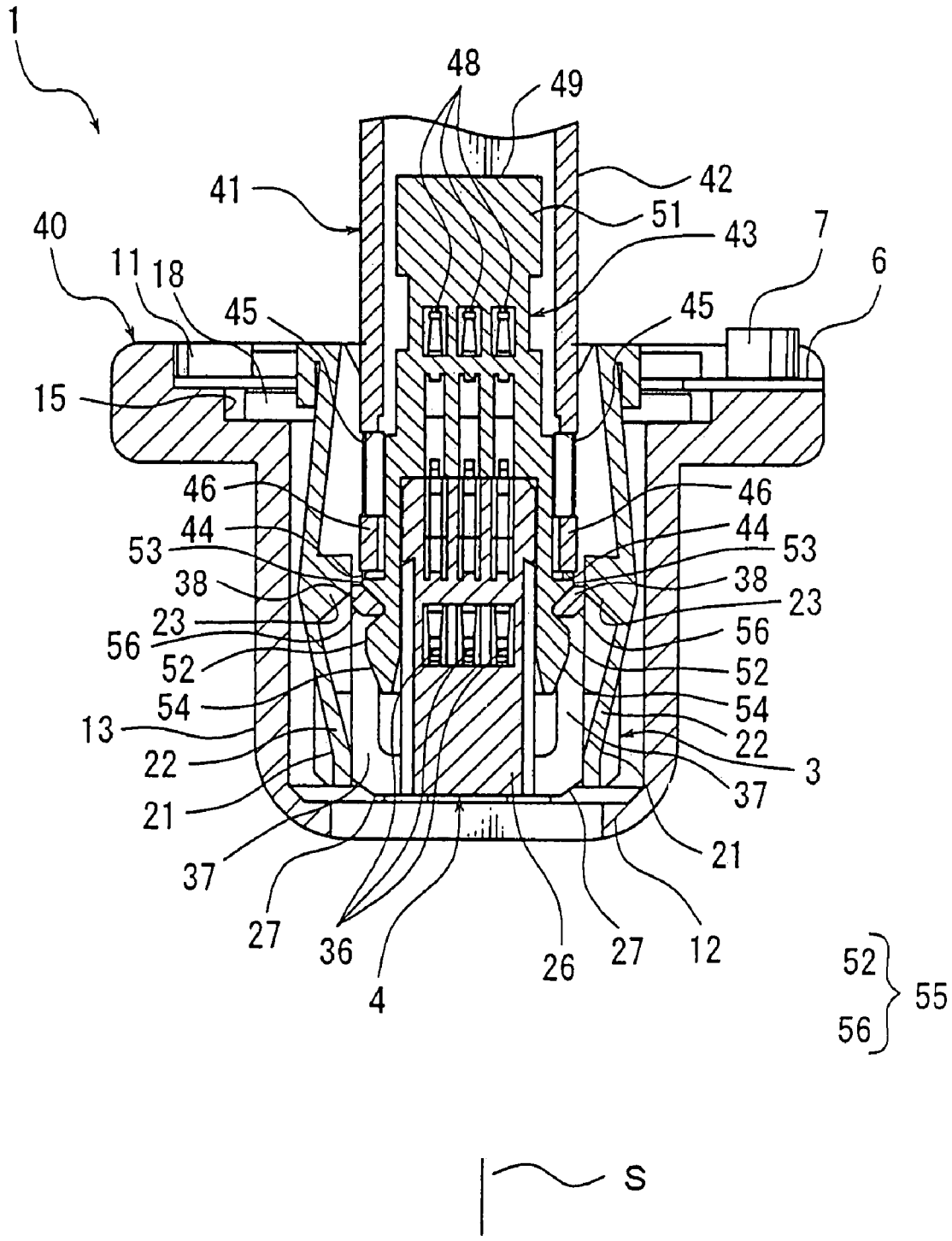
FIG. 17 is a sectional view showing a locking projection of the holder locking arm of the holder of the seat side connector unit shown in FIG. 16 running on the locking beak of the first connector.

When the second connector 43 of the headrest side connector unit 41 is further inserted into the holder 3, the pressing projections 53 press the locking beaks 38. Then, as shown in FIG. 16, the locking projections 23 of the holder locking arms 21 slide on the tapered walls 56 formed on the locking beaks 38, so that the locking projections 23 run on the locking beaks 38 of the locking arms 27. Thus, the engagements between the holder locking arms 21 and the locking arms 27 are fully released, and the connectors 4, 43 connected to each other become movable in the holder 3. Then, as shown in FIG. 17, the locking projections 23 of the holder locking arms 21 slide on the locking beaks 38 of the locking arms 27. Then, as shown in FIG. 18, the locking projections 23 of the holder locking arms 21 fully run over the locking beaks 38 of the locking arms 27.

Figure 18:
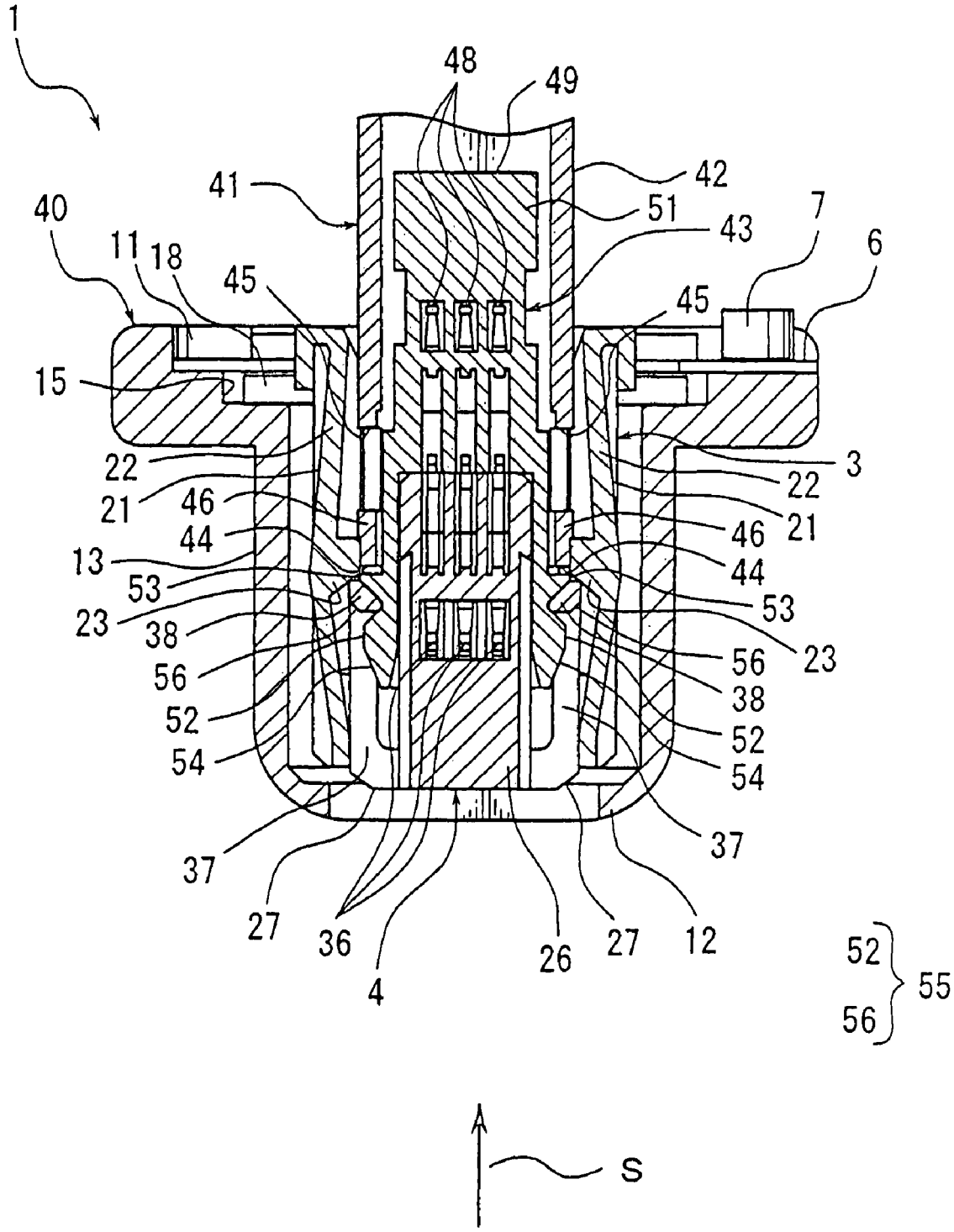
FIG. 18 is a sectional view showing the locking arm of the holder locking arm of the holder of the seat side connector unit shown in FIG. 17 running on a pressed part of the stay (holder) of the headrest side connector unit.
Figure 19:
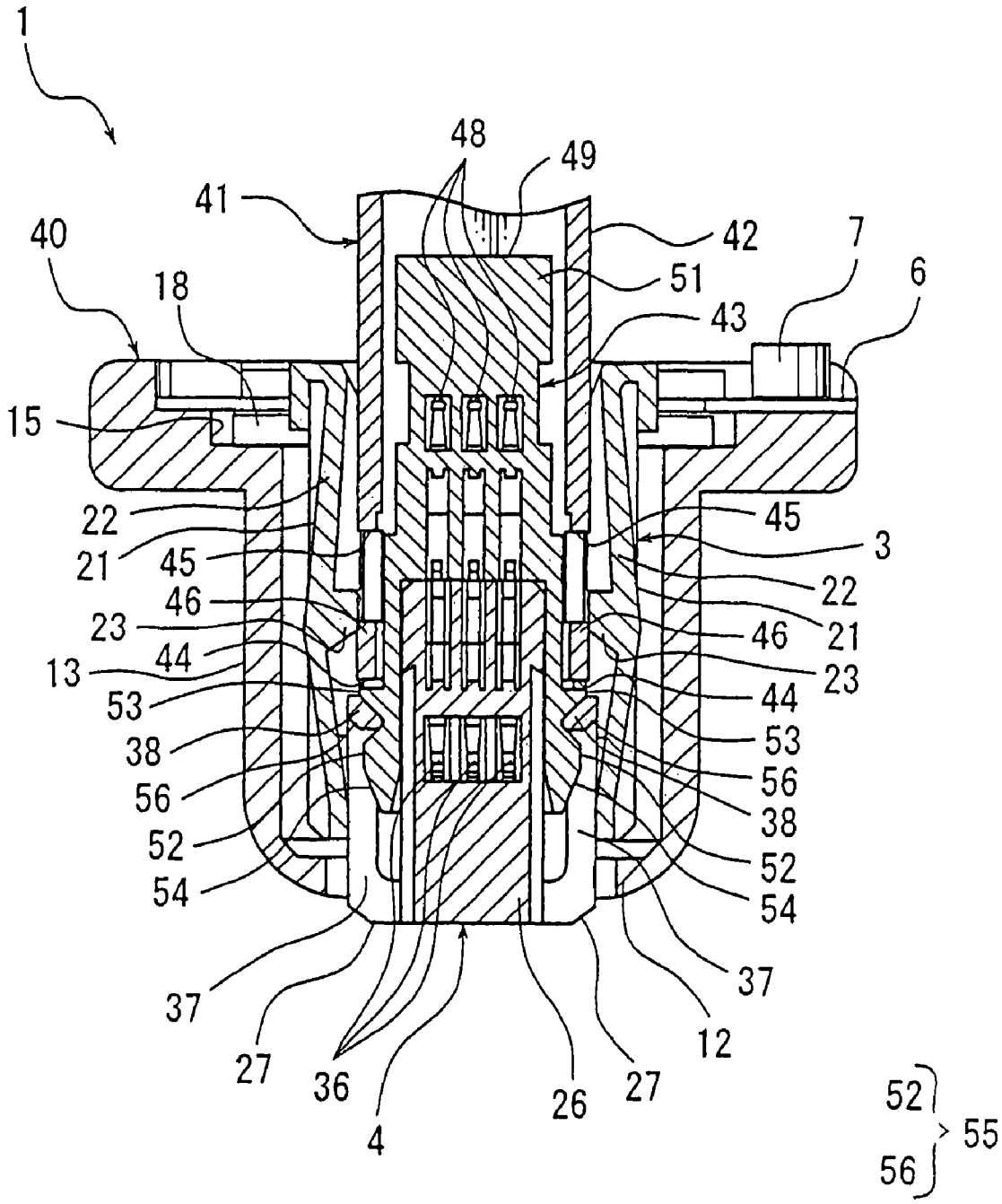
FIG. 19 is a sectional view showing the second connector of the headrest side connector unit inserted into a further rear side of the holder of the seat side connector unit.
Figure 20:
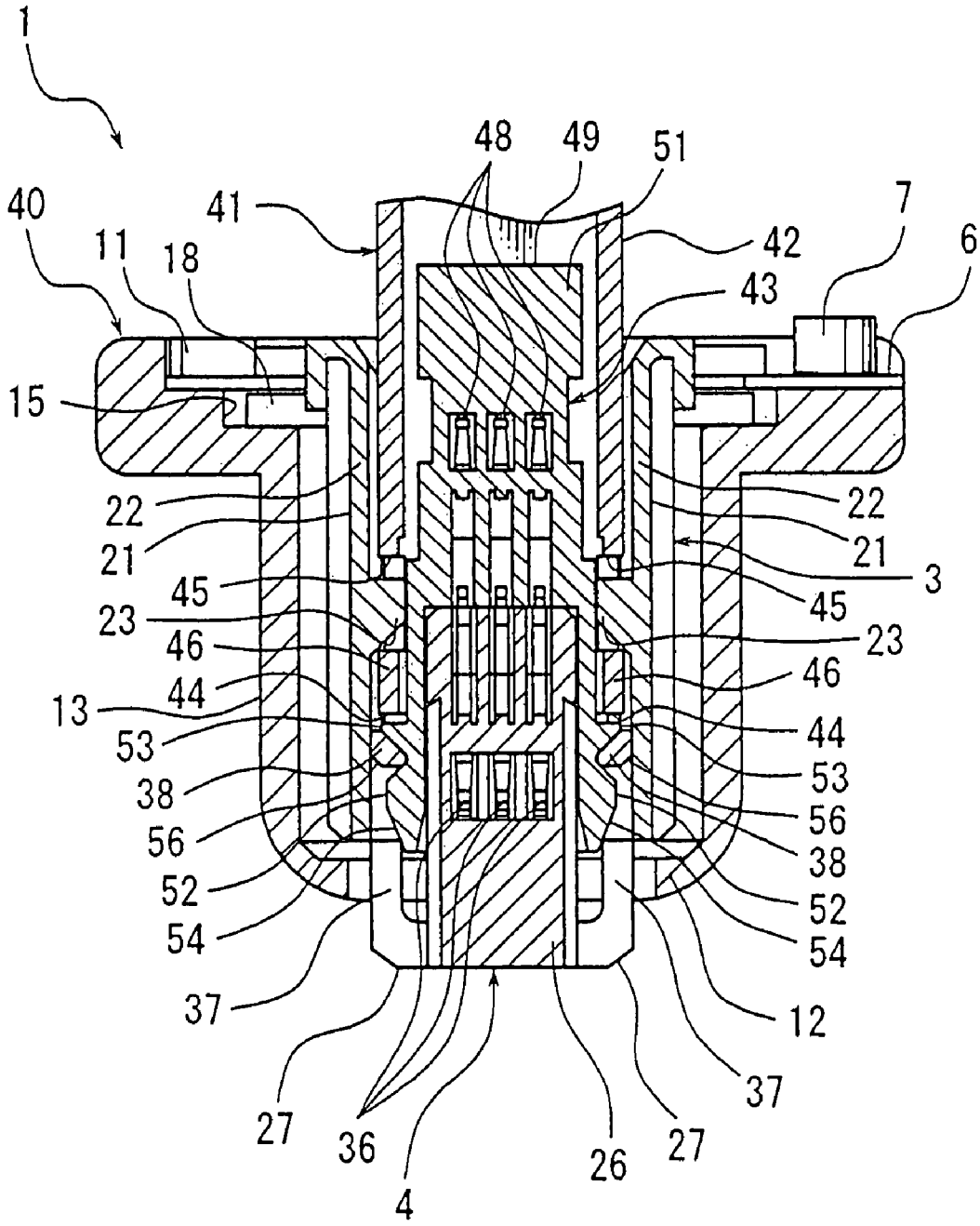
FIG. 20 is a sectional view showing the locking arm of the holder locking arm of the holder of the seat side connector unit inserted into an inserted part of the stay (holder) of the headrest side connector unit.
Figure 21:
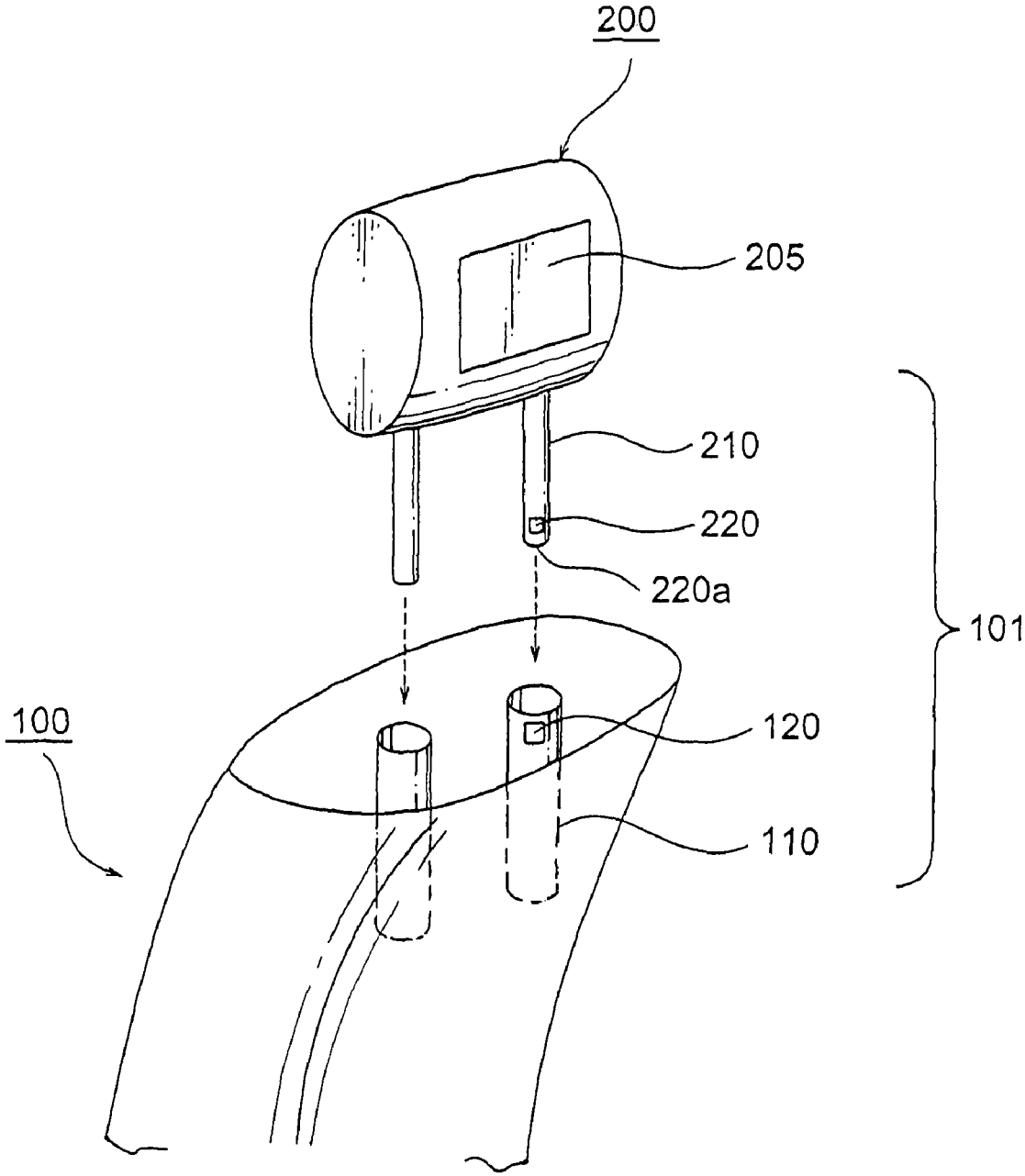
FIG. 21 PRIOR ART
FIG. 21 is a schematic view showing a conventional connection unit.

Then, as shown in FIG. 18, the locking projections 23 of the holder locking arms 21 abut on the pressed parts 46 of the stay 42, and the locking projections 23 of the holder locking arms 21 press the pressed parts 46 toward the holder 3, namely, an inside of the stay 42 owing to the resilient force of the arm main bodies 22. As shown in FIG. 19, when the second connector 43 of the headrest side connector unit 41 is further inserted into the holder 3, the locking projections 23 of the holder locking arms 21 slide on the pressed parts 46. Then, as shown in FIG. 20, the locking projections 23 of the holder locking arms 21 run over the pressed parts 46 to be inserted into the insertion holes 45. As shown in FIG. 20, when the locking projections 23 are inserted into the insertion holes 45, the arm main bodies 22, namely, the holder locking arms 21 return to the neutral positions without deformation. Further, as shown in FIG. 20, an end of the connector housing 24 of the first connector 4 away from the headrest side connector unit 41 is projected outward from the holder 3.

Then, the slit 14, the slit 47, and the notches 44 communicate with each other. The straight part 29 of the clip 5 is inserted into the slits 14, 47, and the notches 44, so that the clip 5 is attached to the seat side connector unit 40 and the headrest side connector unit 41. The clip 5 positions the receiving member main body 10, the holder 3, and the stay 42 relative to each other to position the connectors 4, 43 connected to each other relative to the holder 3. Thus, in connection unit 1, the seat side connector unit 40 and the headrest side connector unit 41 are connected to each other, namely, the connectors 4, 43 are connected to each other, and the clip 5 supports a load from the stay 42. When the connectors 4, 43 are connected to each other, the terminal fittings 36, 48 are connected to each other. Thus, the connection unit 1 connects the electronic components at a vehicle side to the electronic components mounted on the headrest, and supplies the electric power and the signals to the electronic components mounted on the headrest.

According to this embodiment, because the tip part 51*b* of the housing main body 51 is disposed further outside of the stay 42 than the one end of the metallic stay 42, when the second connector 43 is connected to the first connector 4, the edges 42*a* of the stay 42 is prevented from hitting the other parts such as the first connector 4 or the holder 3. Therefore, these parts are prevented from being damaged. Further, because the second connector 43 and the stay 42 are surely fastened, even when they are vibrated while a vehicle is running, the second connector 4 is prevented from rattling and the noise is prevented from generating. Further, by bending the housing main body 51, the projection 430 can be removed from the projection insertion hole 420. Thus, it is easy to separate the second connector 43 from the stay 42.

Further, because the outer surface of the tip part 51*b* of the second connector 43 is arranged in the same plane as the outer surface of the one end of the stay 42, and there is no large projection or depression on the outer surface of the headrest side connector unit 41 around the axis thereof, a useless gap is prevented from generating between the headrest side connector unit 41 and the holder 3, a dust is prevented from entering the gap, and the stay 42 is prevented from rattling. Further, the connection unit 1 can be downsized. Further, because the outer surface of the headrest side connector unit 41 around the axis thereof is formed a substantially flush surface, even when the headrest side connector unit 41 is moved in the axis direction, the headrest side connector unit 41 is prevented from being caught on the holder 3. Therefore, the insertion into the holder 3, the connection and release to the first connector 4, and the like can be performed smoothly.

Further, because the second connector 43 is received in the stay 42, and the stay 42 is inserted into the holder 3 receiving the connector 4, when the stay 42 is inserted into the holder 3, the second connector 43 is automatically connected to the first connector 4. Therefore, the connecting operation to the first connector 4 can be done with a few man-hours.

According to the embodiment described above, the connection unit 1 supplies the desired signal to the electronic components attached to the headrest, and the headrest side connector unit 41 composes the connection unit 1. However, the present invention is not limited to this. Articles without the headrest and the seat may be used. Articles without vehicle parts can be used for attaching the electronic components to which the signals are supplied. Further, according to the present invention, the projection 430 may be formed on the stay 42, and the projection insertion hole 420 may be formed on the housing main body 51.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A connector unit comprising:

a holder (42) in which a connector (43) is received and a slit (47) is formed;

a mating holder (3) in which a mating connector (4) is received and a notch (20) is formed;

a receiving member (9) in which the mating holder (3) is received and a slit (14) is formed; and a clip (5) inserted into the slit (47) of the holder (42), the notch (20) of the mating holder (3), and the slit (14) of the receiving member (9), while the mating holder (3) is received in the receiving member (9) and the holder (42) is received in the mating holder (3), so that the holder (42), the mating holder (3) and the receiving member (9) are relatively positioned and connected to each other on forming of an electrical connection between the connector (43) and the mating connector (4) in the mating holder (3).

2. The connector unit according to claim 1, wherein the slit (47) of the holder (42), the notch (20) of the mating holder (3), and the slit (14) of the receiving member (9) each are formed in a straight line.

3. The connector unit according to claim 1, wherein the slit (47) of the holder (42), the notch (20) of the mating holder (3), and the slit (14) of the receiving member (9) each are formed perpendicular to a longitudinal axis of the holder (42), the mating holder (3), and the receiving member (9).

4. The connector unit according to claim 1, wherein the clip (5) is formed in a substantially U shape.

5. The connector unit according to claim 1, wherein the clip (5) is integrally made of metal.

6. The connector unit according to claim 1, wherein the clip (5) includes a straight part (29), a wave part (30) extending parallel to the straight part (29), and an arc part (31) connecting both ends of the straight part (29) and the wave part (30).

7. The connector unit according to claim 6, wherein the clip (5) is resiliently deformable in a direction of approaching and separating the straight part (29) and the wave part (30).

8. The connector unit according to claim 6, wherein the straight part (29) of the clip (5) is inserted into the slit (47) of the holder (42), the notch (20) of the mating holder (3), and the slit (14) of the receiving member (9).

9. The connector unit according to claim 6, wherein the receiving member (9) is held between the straight part (29) and the wave part (30) of the clip (5).

* * * * *

UNITED STATES PATENT AND TRADEMARK OFFICE

CERTIFICATE OF CORRECTION

PATENT NO. : 7,753,708 B2
APPLICATION NO. : 11/893950
DATED : July 13, 2010
INVENTOR(S) : Yoshida et al.

It is certified that error appears in the above-identified patent and that said Letters Patent is hereby corrected as shown below:

On the Title Page, Item (73) Assignee should read;

-- (73) Assignees: Yazaki Corporation, Tokyo (JP);
Toyota Boshoku Kabushiki Kaisha, Kariya-shi (JP) --

Signed and Sealed this
Fourth Day of January, 2011

David J. Kappos

David J. Kappos
*Director of the United States Patent and Trademark Office*